US010309391B2

(12) United States Patent
Matsuda et al.

(10) Patent No.: US 10,309,391 B2
(45) Date of Patent: Jun. 4, 2019

(54) BELLOWS PUMP DEVICE

(71) Applicant: NIPPON PILLAR PACKING CO., LTD., Osaka (JP)

(72) Inventors: Yuta Matsuda, Osaka (JP); Atsushi Nakano, Osaka (JP); Keiji Nagae, Osaka (JP); Kenji Yamazaki, Osaka (JP); Masaki Miyamoto, Osaka (JP)

(73) Assignee: NIPPON PILLAR PACKING CO., LTD., Osaka-shi, Osaka (JP)

( * ) Notice: Subject to any disclaimer, the term of this patent is extended or adjusted under 35 U.S.C. 154(b) by 212 days.

(21) Appl. No.: 15/313,696

(22) PCT Filed: Jul. 6, 2015

(86) PCT No.: PCT/JP2015/069374
§ 371 (c)(1),
(2) Date: Nov. 23, 2016

(87) PCT Pub. No.: WO2016/021350
PCT Pub. Date: Feb. 11, 2016

(65) Prior Publication Data

US 2017/0191476 A1 Jul. 6, 2017

(30) Foreign Application Priority Data

Aug. 8, 2014 (JP) ..... 2014-162125
Dec. 5, 2014 (JP) ..... 2014-246756

(51) Int. Cl.
*F04B 49/08* (2006.01)
*F04B 43/08* (2006.01)
(Continued)

(52) U.S. Cl.
CPC ..... *F04B 49/08* (2013.01); *F04B 43/08* (2013.01); *F04B 43/10* (2013.01); *F04B 43/113* (2013.01);
(Continued)

(58) Field of Classification Search
CPC ..... F04B 43/10; F04B 43/113; F04B 43/1133; F04B 43/1136
(Continued)

(56) References Cited

U.S. PATENT DOCUMENTS 4,699,615 A * 10/1987 Fischell ..... A61M 5/1424 128/DIG. 12
5,088,898 A * 2/1992 Fukumoto ..... F04B 43/1136 417/343
(Continued)

FOREIGN PATENT DOCUMENTS

EP 0431753 A1 6/1991
EP 1156217 A1 11/2001
(Continued)

OTHER PUBLICATIONS

Compensation Systems for Low Temperature Applications, by B T Scoczen, published 2004.*
(Continued)

*Primary Examiner* — Charles G Freay
*Assistant Examiner* — Thomas Fink
(74) *Attorney, Agent, or Firm* — Millen, White, Zelano & Branigan, P.C.; William Nixon

(57) ABSTRACT

Provided is a bellows pump device that is able to reduce fall of a discharge pressure of a transport fluid during contraction operation of a bellows. The bellows pump device supplies pressurized air to a hermetic discharge-side air chamber thereby to cause a bellows disposed within the discharge-side air chamber to perform contraction operation to discharge a transport fluid, and discharges the pressurized air from the discharge-side air chamber thereby to cause the bellows to perform expansion operation to suck the transport fluid. The bellows pump device includes an electropneumatic regulator configured to adjust an air pressure of the
(Continued)

pressurized air to be supplied to the discharge-side air chamber, such that the air pressure is increased so as to correspond to a contraction characteristic of the bellows during the contraction operation of the bellows.

5 Claims, 22 Drawing Sheets

(51) Int. Cl.
*F04B 43/10* (2006.01)
*F04B 43/113* (2006.01)
*F04B 49/03* (2006.01)
*F04B 49/22* (2006.01)
*F04B 53/10* (2006.01)

(52) U.S. Cl.
CPC ..... *F04B 49/03* (2013.01); *F04B 49/22* (2013.01); *F04B 53/10* (2013.01); *F04B 2205/10* (2013.01)

(58) Field of Classification Search
USPC ..... 417/473
See application file for complete search history.

(56) References Cited

U.S. PATENT DOCUMENTS

| | | | | | |
|---|---|---|---|---|---|
| 5,222,873 | A * | 6/1993 | Whitehead | F01L 25/066 | 137/596.18 |
| 5,224,841 | A * | 7/1993 | Thompson | F04B 9/1174 | 417/392 |
| 5,235,971 | A * | 8/1993 | Falb | A61M 16/18 | 128/203.12 |
| 5,641,270 | A * | 6/1997 | Sgourakes | F04B 17/04 | 417/322 |
| 6,024,345 | A * | 2/2000 | Nishio | F16F 1/027 | 267/148 |
| 6,945,761 | B1 | 9/2005 | Nishio et al. | | |
| 8,025,297 | B2 * | 9/2011 | Smith | G01L 7/061 | 277/635 |
| 2004/0037722 | A1 * | 2/2004 | Watanabe | F04B 43/084 | 417/473 |
| 2007/0177998 | A1 | 8/2007 | Kato | | |
| 2010/0119392 | A1 * | 5/2010 | Masuda | F04B 43/084 | 417/472 |
| 2011/0318207 | A1 * | 12/2011 | Katsura | F04B 43/084 | 417/472 |
| 2014/0010689 | A1 * | 1/2014 | Iwabuchi | F04B 43/10 | 417/472 |
| 2014/0072465 | A1 * | 3/2014 | Adachi | F04B 43/084 | 417/472 |

FOREIGN PATENT DOCUMENTS

| | | | | |
|---|---|---|---|---|
| JP | 48-020807 | B1 | 6/1973 | |
| JP | S4820807 | B1 | 6/1973 | |
| JP | 2012-211512 | A | 7/1993 | |
| JP | 2000-002187 | A | 1/2000 | |
| JP | 2005171946 | A | 6/2005 | |
| JP | WO 2010143469 | A1 * | 12/2010 | F04B 9/137 |
| JP | 2011-117322 | A | 6/2011 | |
| JP | 2011117322 | A1 * | 6/2011 | F04B 43/08 |
| WO | 2010/143469 | A | 12/2010 | |

OTHER PUBLICATIONS

English Machine Translation of JP48020807, Publication Date: Jun. 23, 1973.
International Search Report dated Oct. 6, 2015, issued in corresponding PCT/JP2015/069374, 2 pages.
English translation of JP2000-002187A published Jan. 7, 2000 (13 page).
English translation Abstract of WO2010143469A published Dec. 16, 2010 (1 page).
English translation of JP2011-117322A published Jun. 16, 2011 (31 page).
English translation of JP4820807A published Nov. 24, 2011 (7 page).
English translation Abstract of JP2012211512A published Nov. 1, 2012 (2 page).
Extended European Search Report dated Jan. 17, 2018 for corresponding European Application No. 15830247.1.
English Machine Translation of JP-2005171946, Publication Date: Jun. 30, 2005.

* cited by examiner

FIG. 14

6f

| TEMPERATURE RANGE (° C) | PRESSURE INCREASE COEFFICIENT a |
|---|---|
| LOW TEMPERATURE RANGE (10 TO 20) | a1 |
| INTERMEDIATE TEMPERATURE RANGE (20 TO 60) | a2 |
| HIGH TEMPERATURE RANGE (60 TO 80) | a3 |

BELLOWS PUMP DEVICE

TECHNICAL FIELD

The present invention relates to a bellows pump device.

BACKGROUND ART

In semiconductor production, chemical industries, or the like, a bellows pump may be used as a pump for feeding a transport fluid such as a chemical solution, a solvent, or the like.

For example, as disclosed in PATENT LITERATURE 1, in the bellows pump, pump cases are connected to both sides of a pump head in a right-left direction (horizontal direction) to form two air chambers, and a pair of expandable/contractible bellows are provided within the respective air chambers, and the bellows pump is configured such that each bellows is contracted or expanded by alternately supplying pressurized air to the respective air chambers. To the bellows pump, a mechanical regulator is connected which adjusts the pressurized air to be supplied to each air chamber, into an appropriate air pressure.

In the pump head, a suction passage and a discharge passage for the transport fluid are formed so as to communicate with the interior of each bellows, and further check valves are provided which permit flow of the transport fluid in one direction in the suction passage and the discharge passage and blocks flow of the transport fluid in another direction in the suction passage and the discharge passage. The check valve for the suction passage is configured: to be opened by expansion of the bellows, to permit flow of the transport fluid from the suction passage into the bellows; and to be closed by contraction of the bellows, to block flow of the transport fluid from the interior of the bellows to the suction passage. In addition, the check valve for the discharge passage is configured: to be closed by expansion of the bellows, to block flow of the transport fluid from the discharge passage into the bellows; and to be opened by contraction of the bellows, to permit flow of the transport fluid from the interior of the bellows to the discharge passage.

The pair of bellows are integrally connected to each other by a tie rod. When one of the bellows contracts to discharge the transport fluid to the discharge passage, the other bellows forcedly expands at the same time, so that the transport fluid is sucked from the suction passage. In addition, when the other bellows contracts to discharge the transport fluid to the discharge passage, the one bellows forcedly expands at the same time, so that the transport fluid is sucked from the suction passage.

CITATION LIST

Patent Literature

PATENT LITERATURE 1: Japanese Laid-Open Patent Publication No. 2012-211512

SUMMARY OF INVENTION

Technical Problem

In the bellows pump having the above configuration, when the pressurized air is supplied to the air chamber formed at the outer side of the bellows to cause the bellows to contract, as the contraction proceeds, stress required to cause the bellows to contract increases. Thus, it is necessary to increase the air pressure of the pressurized air to be supplied to the air chamber. However, the mechanical regulator, which adjusts the air pressure of the pressurized air, cannot perform control in which the valve is temporarily opened for increasing the air pressure of the air chamber. Thus, as shown in FIG. 22, while each bellows contracts, a phenomenon occurs that the discharge pressure of the transport fluid gradually falls (portions surrounded by dotted lines in the drawing), causing pulsation.

The present invention has been made in view of such a situation, and an object of the present invention is to provide a bellows pump device that is able to reduce fall of a discharge pressure of a transport fluid during contraction operation of a bellows.

Solution to Problem

A bellows pump device of the present invention is a bellows pump device that supplies pressurized air to a hermetic air chamber thereby to cause a bellows disposed within the air chamber to perform contraction operation to discharge a transport fluid, and discharges the pressurized air from the air chamber thereby to cause the bellows to perform expansion operation to suck the transport fluid, the bellows pump device including an electropneumatic regulator configured to adjust an air pressure of the pressurized air to be supplied to the air chamber, such that the air pressure is increased so as to correspond to a contraction characteristic of the bellows during the contraction operation of the bellows.

According to the bellows pump device configured as describe above, during contraction operation of the bellows, the air pressure of the pressurized air to be supplied to the air chamber is increased by the electropneumatic regulator so as to correspond to the contraction characteristic of the bellows, so that the air pressure of the pressurized air in the air chamber can be increased as the bellows contracts. Accordingly, fall of the discharge pressure of the transport fluid during contraction of the bellows can be reduced.

The electropneumatic regulator preferably adjusts the air pressure every unit time by using the following equation:

$$P=aX+b,$$

wherein P denotes the air pressure, a denotes a pressure increase coefficient, X denotes an expansion/contraction position of the bellows, and b denotes an initial air pressure.

In this case, fall of the discharge pressure of the transport fluid during contraction of the bellows can be effectively reduced.

In the above bellows pump device, preferably, the bellows includes a first bellows and a second bellows that are expandable/contractible independently of each other, and the bellows pump device further includes: a first driving device configured to cause the first bellows to perform expansion/contraction operation continuously between a most expanded state and a most contracted state; a second driving device configured to cause the second bellows to perform expansion/contraction operation continuously between a most expanded state and a most contracted state; a first detection device configured to detect an expanded/contracted state of the first bellows; a second detection device configured to detect an expanded/contracted state of the second bellows; and a control unit configured to control drive of the first and second driving devices on the basis of each of detection signals of the first and second detection device such that the second bellows is caused to contract from the most expanded state before the first bellows comes into the most contracted state, and the first bellows is caused to contract from the most expanded state before the second bellows comes into the most contracted state.

In this case, the first bellows and the second bellows are made expandable/contractible independently of each other, and the control unit is configured to perform drive control such that the second bellows is caused to contract from the most expanded state before the first bellows comes into the most contracted state, and the first bellows is caused to contract from the most expanded state before the second bellows comes into the most contracted state. Thus, at timing of switching from contraction of one bellows (discharge) to expansion thereof (suction), the other bellows has already contracted to discharge the transport fluid. Accordingly, fall of the discharge pressure at the timing of switching can be reduced. As a result, pulsation at the discharge side of the bellows pump device can be reduced.

With the above bellows pump device, since the electropneumatic regulator outputs the pressurized air in output cycles such that the air pressure of the pressurized air always has a constant pressure increase coefficient, the following problem may arise.

Specifically, for example, in the case a high-temperature transport fluid and a low-temperature transport fluid are fed in this order by the bellows pump device, when switching from feeding of the high-temperature transport fluid to feeding of the low-temperature transport fluid is performed, the bellows may become hard due to a decrease in the temperature of the transport fluid sucked into the bellows. When such a change occurs, the bellows becomes difficult to contract, but the electropneumatic regulator outputs the pressurized air in output cycles such that the air pressure has a constant pressure increase coefficient regardless of the hardness of the bellows. Thus, the discharge pressure of the transport fluid decreases, so that the discharge pressure cannot be maintained constant.

When the discharge pressure of the transport fluid cannot be maintained constant, pulsation of the bellows pump device increases, which may have an adverse effect on a semiconductor production process, such as foreign matter flowing in through a filter provided in the middle of a feed pipe for the transport fluid, or collapse of a pattern on a wafer due to pulsation of the transport fluid sprayed from a nozzle end.

Therefore, the above bellows pump device preferably further includes: a temperature detection unit configured to detect a temperature of the transport fluid; and a control unit configured to control the electropneumatic regulator such that a pressure increase coefficient used in increasing the air pressure increases as a detection value of the temperature detection unit decreases.

In this case, the control unit controls the electropneumatic regulator such that the pressure increase coefficient for the air pressure of the pressurized air to be supplied to the air chamber during the contraction operation of the bellows increases as the temperature of the transport fluid detected by the temperature detection unit decreases. Accordingly, for example, even when the temperature of the transport fluid decreases so that the bellows becomes hard, the bellows can be caused to contract by the air pressure higher than the air pressure prior to the temperature decrease of the transport fluid, since the pressure increase coefficient for the air pressure of the pressurized air to be supplied to the air chamber increases. Therefore, even when the hardness of the bellows changes due to a temperature change of the transport fluid, change of the discharge pressure of the transport fluid during contraction of the bellows can be suppressed.

The control unit preferably sets the pressure increase coefficient for the air pressure on the basis of the detection value of the temperature detection unit such that a maximum value of the air pressure does not exceed an allowable withstand pressure of the bellows.

In this case, even when the pressure increase coefficient for the air pressure of the pressurized air to be supplied to the air chamber increases, the maximum value of the air pressure does not exceed the allowable withstand pressure of the bellows. Thus, the bellows can be prevented from being deformed or broken due to an increase in the air pressure.

Preferably, the control unit has a look-up table in which the pressure increase coefficient is set so as to correspond to each of a plurality of temperature ranges, and controls the electropneumatic regulator on the basis of the look-up table.

In this case, the electropneumatic regulator can be easily controlled on the basis of the look-up table.

Advantageous Effects of Invention

According to the bellows pump device of the present invention, fall of the discharge pressure of the transport fluid during contraction operation of the bellows can be reduced.

BRIEF DESCRIPTION OF DRAWINGS

FIG. 14 is an example of a look-up table of a control unit of the second embodiment.

DESCRIPTION OF EMBODIMENTS

Next, preferred embodiments of the present invention will be described with reference to the accompanying drawings.

[First Embodiment]

<Entire Configuration of Bellows Pump>

Figure 1:
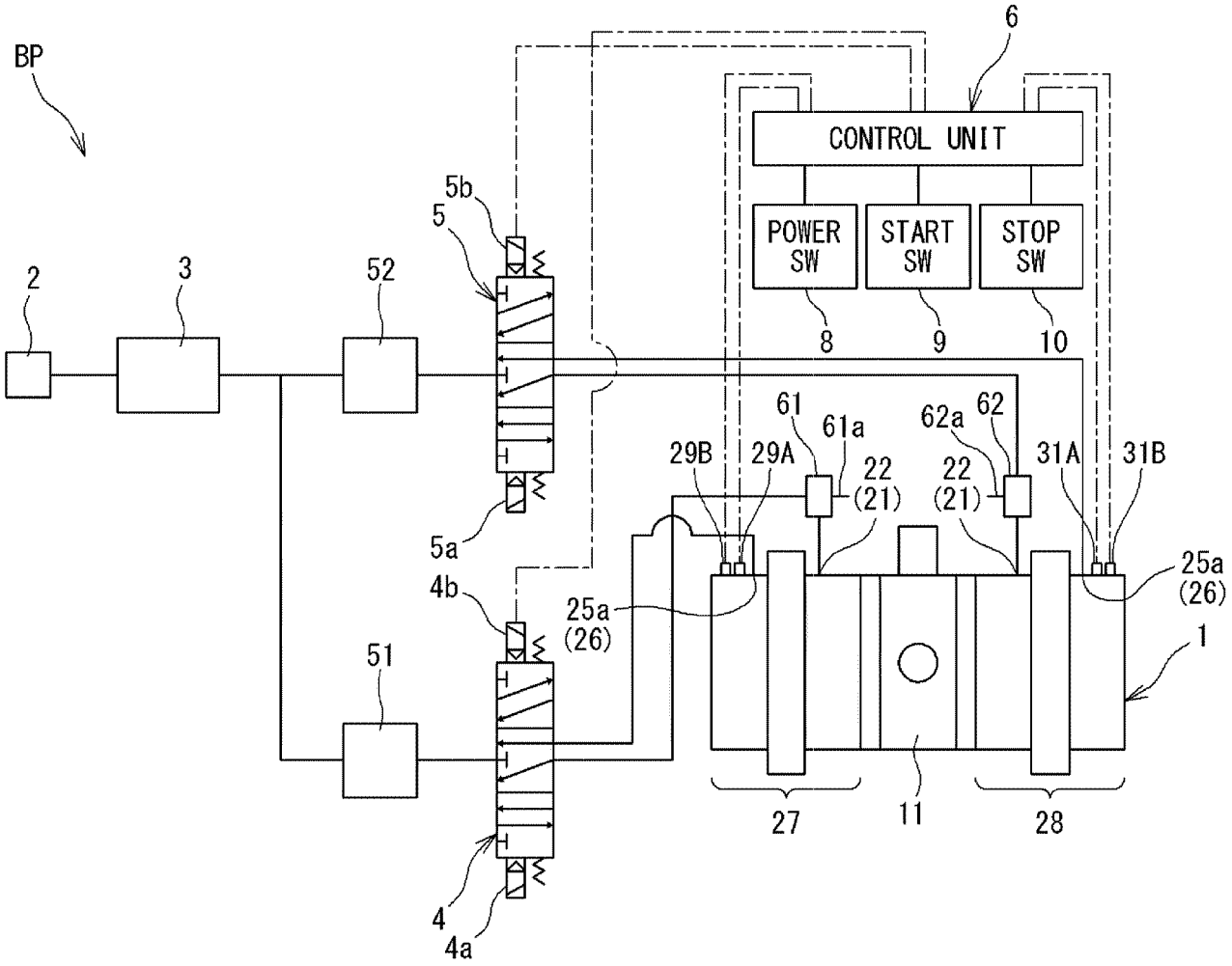
FIG. 1 is a schematic configuration diagram of a bellows pump device according to a first embodiment of the present invention.

FIG. 1 is a schematic configuration diagram of a bellows pump device according to a first embodiment of the present invention. The bellows pump device BP of the present embodiment is used, for example, in a semiconductor production apparatus when a transport fluid such as a chemical solution, a solvent, or the like is supplied in a certain amount. The bellows pump device BP includes: a bellows pump 1; an air supply device 2 such as an air compressor or the like which supplies pressurized air (working fluid) to the bellows pump 1; a mechanical regulator 3 and two first and second electropneumatic regulators 51 and 52 that adjust the air pressure of the pressurized air; two first and second switching valves 4 and 5; and a control unit 6 that controls drive of the bellows pump 1.

Figure 2:
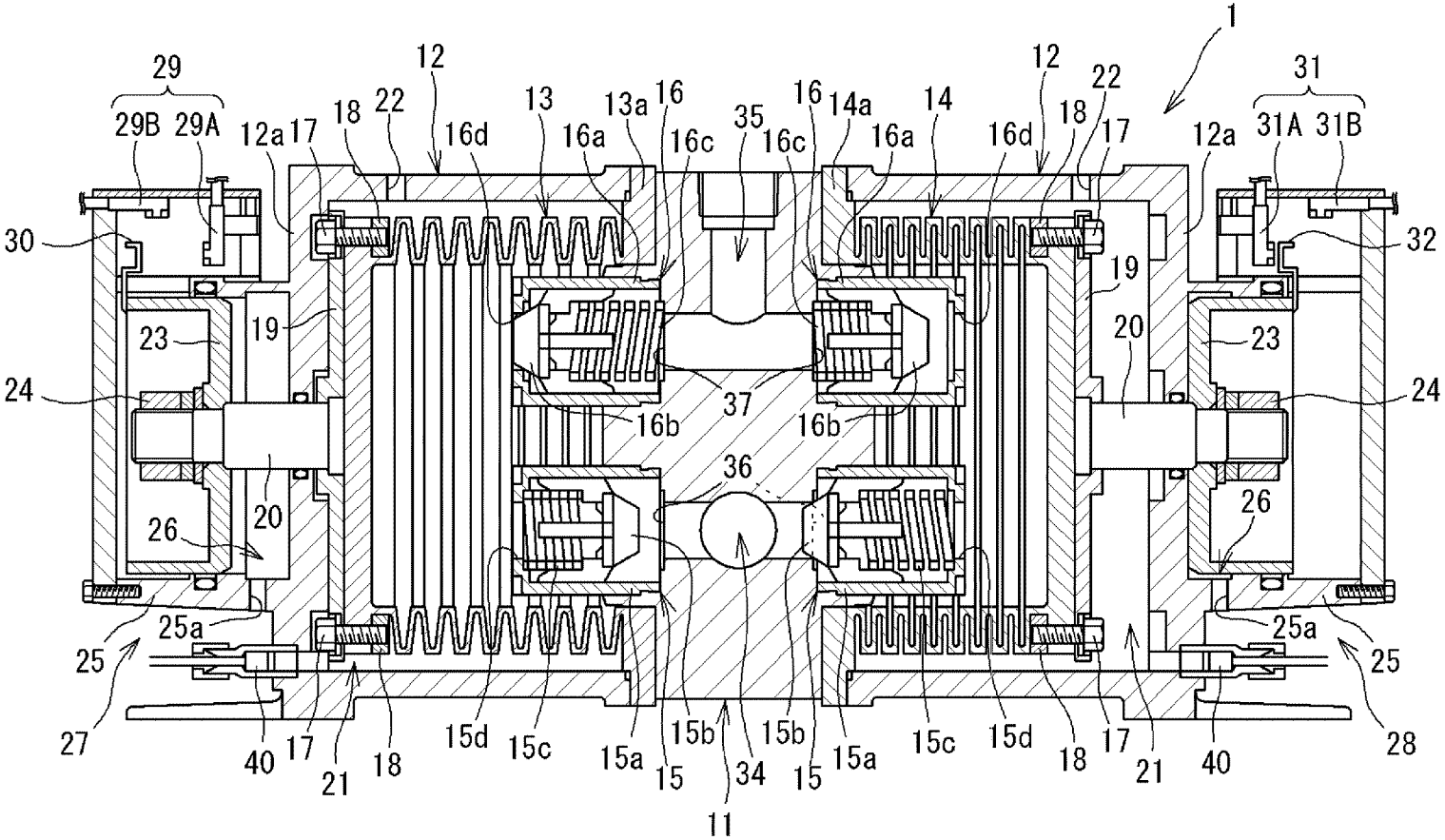
FIG. 2 is a cross-sectional view of a bellows pump.

FIG. 2 is a cross-sectional view of the bellows pump of the present embodiment.

The bellows pump 1 of the present embodiment includes: a pump head 11; a pair of pump cases 12 that are mounted at both sides of the pump head 11 in a right-left direction (horizontal direction); two first and second bellows 13 and 14 that are mounted on side surfaces of the pump head 11 in the right-left direction and within the respective pump cases 12; and four check valves 15 and 16 that are mounted on the side surfaces of the pump head 11 in the right-left direction and within the respective bellows 13 and 14.

<Configurations of Bellows>

The first and second bellows 13 and 14 are each formed in a bottomed cylindrical shape from a fluorine resin such as polytetrafluoroethylene (PTFE), a tetrafluoroethylene-perfluoro alkyl vinyl ether copolymer (PFA), or the like, and flange portions 13*a* and 14*a* are integrally formed at open end portions thereof and are hermetically pressed and fixed to the side surfaces of the pump head 11. Peripheral walls of the first and second bellows 13 and 14 are each formed in an accordion shape, and are configured to be expandable/contractible independently of each other in the horizontal direction. Specifically, each of the first and second bellows 13 and 14 is configured to expand/contract between a most expanded state where an outer surface of a working plate 19 described later is in contact with an inner side surface of a bottom wall portion 12*a* of the pump case 12 and a most contracted state where an inner side surface of a piston body 23 described later is in contact with an outer side surface of the bottom wall portion 12*a* of the pump case 12.

The working plate 19, together with one end portion of a connection member 20, is fixed to each of outer surfaces of bottom portions of the first and second bellows 13 and 14 by bolts 17 and nuts 18.

<Configurations of Pump Cases>

Each pump case 12 is formed in a bottomed cylindrical shape, and an opening peripheral portion thereof is hermetically pressed and fixed to the flange portion 13*a* (14*a*) of the corresponding bellows 13 (14). Thus, a discharge-side air chamber 21 is formed within the pump case 12 such that a hermetic state thereof is maintained.

An suction/exhaust port 22 is provided in each pump case 12 and connected to the air supply device 2 via the switching valve 4(5), the electropneumatic regulator 51 (52), and the mechanical regulator 3 (see FIG. 1). Accordingly, the bellows 13 (14) contracts by supplying the pressurized air from the air supply device 2 via the mechanical regulator 3, the electropneumatic regulator 51 (52), the switching valve 4(5), and the suction/exhaust port 22 into the discharge-side air chamber 21.

In addition, the connection member 20 is supported by the bottom wall portion 12*a* of each pump case 12 so as to be slidable in the horizontal direction, and the piston body 23 is fixed to another end portion of the connection member 20 by a nut 24. The piston body 23 is supported so as to be slidable in the horizontal direction relative to an inner circumferential surface of a cylindrical cylinder body 25, which is integrally provided on the outer side surface of the bottom wall portion 12*a*, with a hermetic state maintained. Accordingly, a space surrounded by the bottom wall portion 12*a*, the cylinder body 25, and the piston body 23 is formed as a suction-side air chamber 26 of which a hermetic state is maintained.

In each cylinder body 25, a suction/exhaust port 25*a* is formed so as to communicate with the suction-side air chamber 26. The suction/exhaust port 25*a* is connected to the air supply device 2 via the switching valve 4 (5), the electropneumatic regulator 51 (52), and the mechanical regulator 3 (see FIG. 1). Accordingly, the bellows 13 (14) expands by supplying the pressurized air from the air supply device 2 via the mechanical regulator 3, the electropneumatic regulator 51 (52), the switching valve 4 (5), and the suction/exhaust port 25*a* into the suction-side air chamber 26.

A leakage sensor 40 for detecting leakage of the transport fluid to the discharge-side air chamber 21 is mounted below the bottom wall portion 12*a* of each pump case 12.

In the bellows pump device BP of the present embodiment, a time taken until the suction-side air chamber 26 is fully filled with the pressurized air is shorter than a time taken until the discharge-side air chamber 21 is fully filled with the pressurized air. That is, an expansion time (suction time) for which the bellows 13 (14) expands from the most contracted state to the most expanded state is shorter than a contraction time (discharge time) for which the bellows 13 (14) contracts from the most expanded state to the most contracted state.

Because of the above configuration, the pump case 12 in which the discharge-side air chamber 21 at the left side in FIG. 2 is formed, and the piston body 23 and the cylinder body 25 that form the suction-side air chamber 26 at the left side in FIG. 2, form a first air cylinder portion (first driving device) 27 that causes the first bellows 13 to perform expansion/contraction operation continuously between the most expanded state and the most contracted state.

In addition, the pump case 12 in which the discharge-side air chamber 21 at the right side in FIG. 2 is formed, and the piston body 23 and the cylinder body 25 that form the suction-side air chamber 26 at the right side in FIG. 2, form a second air cylinder portion (second driving device) 28 that causes the second bellows 14 to perform expansion/contraction operation continuously between the most expanded state and the most contracted state.

A pair of proximity sensors 29A and 29B are mounted on the cylinder body 25 of the first air cylinder portion 27, and a detection plate 30 to be detected by each of the proximity sensors 29A and 29B is mounted on the piston body 23. The detection plate 30 reciprocates together with the piston body 23, so that the detection plate 30 alternately comes close to the proximity sensors 29A and 29B, whereby the detection plate 30 is detected by the proximity sensors 29A and 29B.

The proximity sensor 29A is a first most contraction detection unit for detecting the most contracted state of the first bellows 13, and is disposed at such a position that the proximity sensor 29A detects the detection plate 30 when the first bellows 13 is in the most contracted state. The proximity sensor 29B is a first most expansion detection unit for detecting the most expanded state of the first bellows 13, and is disposed at such a position that the proximity sensor 29B detects the detection plate 30 when the first bellows 13 is in the most expanded state. Detection signals of the respective proximity sensors 29A and 29B are transmitted to the control unit 6. In the present embodiment, the pair of proximity sensors 29A and 29B form a first detection device 29 for detecting an expanded/contracted state of the first bellows 13.

Similarly, a pair of proximity sensors 31A and 31B are mounted on the cylinder body 25 of the second air cylinder portion 28, and a detection plate 32 to be detected by each of the proximity sensors 31A and 31B is mounted on the piston body 23. The detection plate 32 reciprocates together with the piston body 23, so that the detection plate 32 alternately comes close to the proximity sensors 31A and 31B, whereby the detection plate 32 is detected by the proximity sensors 31A and 31B.

The proximity sensor 31A is a second most contraction detection unit for detecting the most contracted state of the second bellows 14, and is disposed at such a position that the proximity sensor 31A detects the detection plate 32 when the second bellows 14 is in the most contracted state. The proximity sensor 31B is a second most expansion detection unit for detecting the most expanded state of the second bellows 14, and is disposed at such a position that the proximity sensor 31B detects the detection plate 32 when the second bellows 14 is in the most expanded state. Detection signals of the respective proximity sensors 31A and 31B are transmitted to the control unit 6. In the present embodiment, the pair of proximity sensors 31A and 31B form a second detection device 31 for detecting an expanded/contracted state of the second bellows 14.

The pressurized air generated by the air supply device 2 is alternately supplied to the suction-side air chamber 26 and the discharge-side air chamber 21 of the first air cylinder portion 27 by the pair of proximity sensors 29A and 29B of the first detection device 29 alternately detecting the detection plate 30. Accordingly, the first bellows 13 continuously performs expansion/contraction operation.

In addition, the pressurized air is alternately supplied to the suction-side air chamber 26 and the discharge-side air chamber 21 of the second air cylinder portion 28 by the pair of proximity sensors 31A and 31B of the second detection device 31 alternately detecting the detection plate 32. Accordingly, the second bellows 14 continuously performs expansion/contraction operation. At this time, expansion operation of the second bellows 14 is performed mainly during contraction operation of the first bellows 13, and contraction operation of the second bellows 14 is performed mainly during expansion operation of the first bellows 13. By the first bellows 13 and the second bellows 14 alternately repeating expansion/contraction operation as described above, suction and discharge of the transport fluid to and from the interiors of the respective bellows 13 and 14 are alternately performed, whereby the transport fluid is transported.

<Configuration of Pump Head>

The pump head 11 is formed from a fluorine resin such as PTFE, PFA, or the like. A suction passage 34 and a discharge passage 35 for the transport fluid are formed within the pump head 11. The suction passage 34 and the discharge passage 35 are opened in an outer peripheral surface of the pump head 11 and respectively connected to a suction port and a discharge port (both are not shown) provided at the outer peripheral surface. The suction port is connected to a storage tank for the transport fluid or the like, and the discharge port is connected to a transport destination for the transport fluid. In addition, the suction passage 34 and the discharge passage 35 each branch toward both right and left side surfaces of the pump head 11, and have suction openings 36 and discharge openings 37 that are opened in both right and left side surfaces of the pump head 11. Each suction opening 36 and each discharge opening 37 communicate with the interior of the bellows 13 or 14 via the check valves 15 and 16, respectively.

<Configurations of Check Valves>

The check valves 15 and 16 are provided at each suction opening 36 and each discharge opening 37.

The check valve 15 (hereinafter, also referred to as "suction check valve") mounted at each suction opening 36 includes: a valve case 15*a*; a valve body 15*b* that is housed in the valve case 15*a*; and a compression coil spring 15*c* that biases the valve body 15*b* in a valve closing direction. The valve case 15*a* is formed in a bottomed cylindrical shape, and a through hole 15*d* is formed in a bottom wall thereof so as to communicate with the interior of the bellows 13 or 14. The valve body 15*b* closes the suction opening 36 (performs valve closing) by the biasing force of the compression coil spring 15*c*, and opens the suction opening 36 (performs valve opening) when a back pressure generated by flow of the transport fluid occurring with expansion/contraction of the bellows 13 or 14 acts thereon.

Accordingly, the suction check valve 15 opens when the bellows 13 or 14 at which the suction check valve 15 is disposed expands, to permit suction of the transport fluid in a direction (one direction) from the suction passage 34 toward the interior of the bellows 13 or 14, and closes when the bellows 13 or 14 contracts, to block backflow of the transport fluid in a direction (another direction) from the interior of the bellows 13 or 14 toward the suction passage 34.

The check valve 16 (hereinafter, also referred to as "discharge check valve") mounted at each discharge opening 37 includes: a valve case 16*a*; a valve body 16*b* that is housed in the valve case 16*a*; and a compression coil spring 16*c* that biases the valve body 16*b* in a valve closing direction. The valve case 16*a* is formed in a bottomed cylindrical shape, and a through hole 16*d* is formed in a bottom wall thereof so as to communicate with the interior of the bellows 13 or 14. The valve body 16*b* closes the through hole 16*d* of the valve case 16*a* (performs valve closing) by the biasing force of the compression coil spring 16*c*, and opens the through hole 16*d* of the valve case 16*a* (performs valve opening) when a back pressure generated by flow of the transport fluid occurring with expansion/contraction of the bellows 13 or 14 acts thereon.

Accordingly, the discharge check valve 16 opens when the bellows 13 or 14 at which the discharge check valve 16 is disposed contracts, to permit outflow of the transport fluid in a direction (one direction) from the interior of the bellows 13 or 14 toward the discharge passage 35, and closes when the bellows 13 or 14 expands, to block backflow of the transport fluid in a direction (another direction) from the discharge passage 35 toward the interior of the bellows 13 or 14.

<Operation of Bellows Pump>

Figure 3:
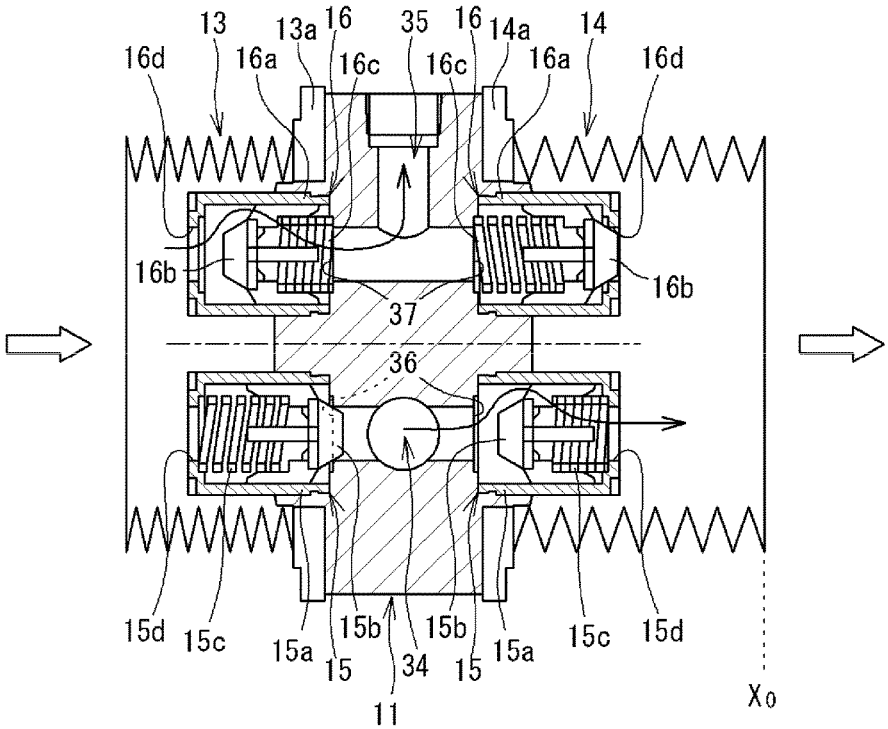
FIG. 3 is an explanatory diagram showing operation of the bellows pump.
Figure 4:
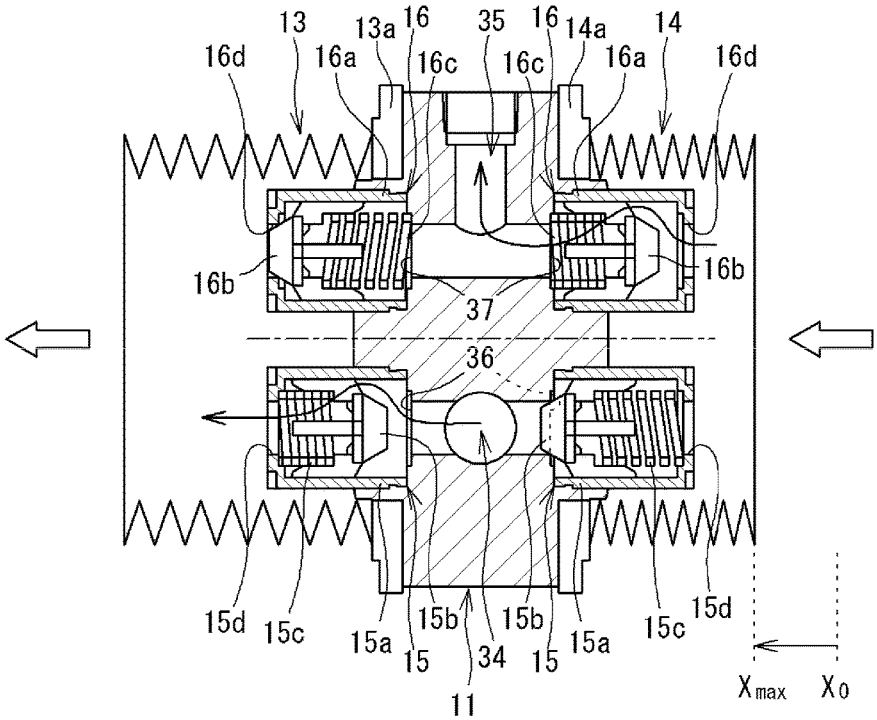
FIG. 4 is an explanatory diagram showing operation of the bellows pump.

Next, operation of the bellows pump 1 of the present embodiment will be described with reference to FIGS. 3 and 4. In FIGS. 3 and 4, the configurations of the first and second bellows 13 and 14 are shown in a simplified manner.

As shown in FIG. 3, when the first bellows 13 contracts and the second bellows 14 expands, the respective valve bodies 15*b* and 16*b* of the suction check valve 15 and the discharge check valve 16 that are mounted at the left side of the pump head 11 in the drawing receive pressure from the transport fluid within the first bellows 13 and move to the right sides of the respective valve cases 15*a* and 16*a* in the drawing. Accordingly, the suction check valve 15 closes, and the discharge check valve 16 opens, so that the transport fluid within the first bellows 13 is discharged through the discharge passage 35 to the outside of the pump.

Meanwhile, the respective valve bodies 15*b* and 16*b* of the suction check valve 15 and the discharge check valve 16 that are mounted at the right side of the pump head 11 in the drawing move to the right sides of the respective valve cases 15*a* and 16*a* in the drawing due to a suction effect by the second bellows 14. Accordingly, the suction check valve 15 opens, and the discharge check valve 16 closes, so that the transport fluid is sucked from the suction passage 34 into the second bellows 14.

Next, as shown in FIG. 4, when the first bellows 13 expands and the second bellows 14 contracts, the respective valve bodies 15*b* and 16*b* of the suction check valve 15 and the discharge check valve 16 that are mounted at the right side of the pump head 11 in the drawing receive pressure from the transport fluid within the second bellows 14 and move to the left sides of the respective valve cases 15*a* and 16*a* in the drawing. Accordingly, the suction check valve 15 closes, and the discharge check valve 16 opens, so that the transport fluid within the second bellows 14 is discharged through the discharge passage 35 to the outside of the pump.

Meanwhile, the respective valve bodies 15*b* and 16*b* of the suction check valve 15 and the discharge check valve 16 that are mounted at the left side of the pump head 11 in the drawing move to the left sides of the respective valve cases 15*a* and 16*a* in the drawing due to a suction effect by the first bellows 13. Accordingly, the suction check valve 15 opens, and the discharge check valve 16 closes, so that the transport fluid is sucked from the suction passage 34 into the first bellows 13.

By repeatedly performing the above operation, the left and right bellows 13 and 14 can alternately suck and discharge the transport fluid.

<Configurations of Switching Valves>

In FIG. 1, the first switching valve 4 switches between supply of the pressurized air from the air supply device 2 to the discharge-side air chamber 21 and the suction-side air chamber 26 of the first air cylinder portion 27 and discharge of the pressurized air from the discharge-side air chamber 21 and the suction-side air chamber 26 of the first air cylinder portion 27, and is composed of, for example, a three-position solenoid switching valve including a pair of solenoids 4*a* and 4*b*. Each of the solenoids 4*a* and 4*b* is magnetized upon reception of a command signal from the control unit 6. Although the first switching valve 4 of the present embodiment is composed of the three-position solenoid switching valve, the first switching valve 4 may be a two-position solenoid switching valve which does not have a neutral position.

When both of the solenoids 4*a* and 4*b* are in a demagnetized state, the first switching valve 4 is maintained at a neutral position, supply of the pressurized air from the air supply device 2 to the discharge-side air chamber 21 (suction/exhaust port 22) and the suction-side air chamber 26 (suction/exhaust port 25*a*) of the first air cylinder portion 27 is blocked, and both the discharge-side air chamber 21 and the suction-side air chamber 26 of the first air cylinder portion 27 communicate with and are open to the atmosphere.

In addition, when the solenoid 4*a* is magnetized, the first switching valve 4 switches to a lower position in the drawing, and the pressurized air is supplied from the air supply device 2 to the discharge-side air chamber 21 of the first air cylinder portion 27. At this time, the suction-side air chamber 26 of the first air cylinder portion 27 communicates with and is open to the atmosphere. Accordingly, the first bellows 13 can be caused to contract.

Furthermore, when the solenoid 4*b* is magnetized, the first switching valve 4 switches to an upper position in the drawing, and the pressurized air is supplied from the air supply device 2 to the suction-side air chamber 26 of the first air cylinder portion 27. At this time, the discharge-side air chamber 21 of the first air cylinder portion 27 communicates with and is open to the atmosphere. Accordingly, the first bellows 13 can be caused to expand.

The second switching valve 5 switches between supply of the pressurized air from the air supply device 2 to the discharge-side air chamber 21 and the suction-side air chamber 26 of the second air cylinder portion 28 and discharge of the pressurized air from the discharge-side air chamber 21 and the suction-side air chamber 26 of the second air cylinder portion 28, and is composed of, for example, a three-position solenoid switching valve including a pair of solenoids 5*a* and 5*b*. Each of the solenoids 5*a* and 5*b* is magnetized upon reception of a command signal from the control unit 6. Although the second switching valve 5 of the present embodiment is composed of the three-position solenoid switching valve, the second switching valve 5 may be a two-position solenoid switching valve which does not have a neutral position.

When both of the solenoids 5*a* and 5*b* are in a demagnetized state, the second switching valve 5 is maintained at a neutral position, supply of the pressurized air from the air supply device 2 into the discharge-side air chamber 21 (suction/exhaust port 22) and the suction-side air chamber 26 (suction/exhaust port 25*a*) of the second air cylinder portion 28 is blocked, and both the discharge-side air chamber 21 and the suction-side air chamber 26 of the second air cylinder portion 28 communicate with and are open to the atmosphere.

In addition, when the solenoid 5*a* is magnetized, the second switching valve 5 switches to a lower position in the drawing, and the pressurized air is supplied from the air supply device 2 to the discharge-side air chamber 21 of the second air cylinder portion 28. At this time, the suction-side air chamber 26 of the second air cylinder portion 28 communicates with and is open to the atmosphere. Accordingly, the second bellows 14 can be caused to contract.

Furthermore, when the solenoid 5*b* is magnetized, the second switching valve 5 switches to an upper position in the drawing, and the pressurized air is supplied from the air supply device 2 to the suction-side air chamber 26 of the second air cylinder portion 28. At this time, the discharge-side air chamber 21 of the second air cylinder portion 28 communicates with and is open to the atmosphere. Accordingly, the second bellows 14 can be caused to expand.

In FIG. 1, a first quick exhaust valve 61 is disposed between the discharge-side air chamber 21 (suction/exhaust port 22) of the first air cylinder portion 27 and the first switching valve 4 and adjacently to the discharge-side air chamber 21. The first quick exhaust valve 61 has an exhaust port 61*a* through which the pressurized air is discharged, and is configured to permit flow of the pressurized air from the first switching valve 4 to the discharge-side air chamber 21 and to discharge the pressurized air flowing out from the discharge-side air chamber 21, through the exhaust port 61*a*. Thus, the pressurized air within the discharge-side air chamber 21 can be quickly discharged through the first quick exhaust valve 61, not via the first switching valve 4.

Similarly, a second quick exhaust valve 62 is disposed between the discharge-side air chamber 21 (suction/exhaust port 22) of the second air cylinder portion 28 and the second switching valve 5 and adjacently to the discharge-side air chamber 21. The second quick exhaust valve 62 has an exhaust port 62*a* through which the pressurized air is discharged, and is configured to permit flow of the pressurized air from the second switching valve 5 to the discharge-side air chamber 21 and to discharge the pressurized air flowing out from the discharge-side air chamber 21, through the exhaust port 62*a*. Thus, the pressurized air within the discharge-side air chamber 21 can be quickly discharged through the second quick exhaust valve 62, not via the second switching valve 5.

A quick exhaust valve is not disposed between the suction-side air chamber 26 (suction/exhaust port 25*a*) of each of the air cylinder portions 27 and 28 and the corresponding switching valve 4 or 5. In the case where quick exhaust valves are mounted at the suction side, the same advantageous effects as those in the case where quick exhaust valves are mounted at the discharge side are obtained, but the effects are not great as compared to those at the discharge side. Thus, in the embodiment, due to the cost, quick exhaust valves at the suction side are not installed.

<Configuration of Control Unit>

The control unit 6 controls drive of each of the first air cylinder portion 27 and the second air cylinder portion 28 of the bellows pump 1 by switching the respective switching valves 4 and 5 on the basis of detection signals of the first detection device 29 and the second detection device 31 (see FIG. 2).

Figure 5:
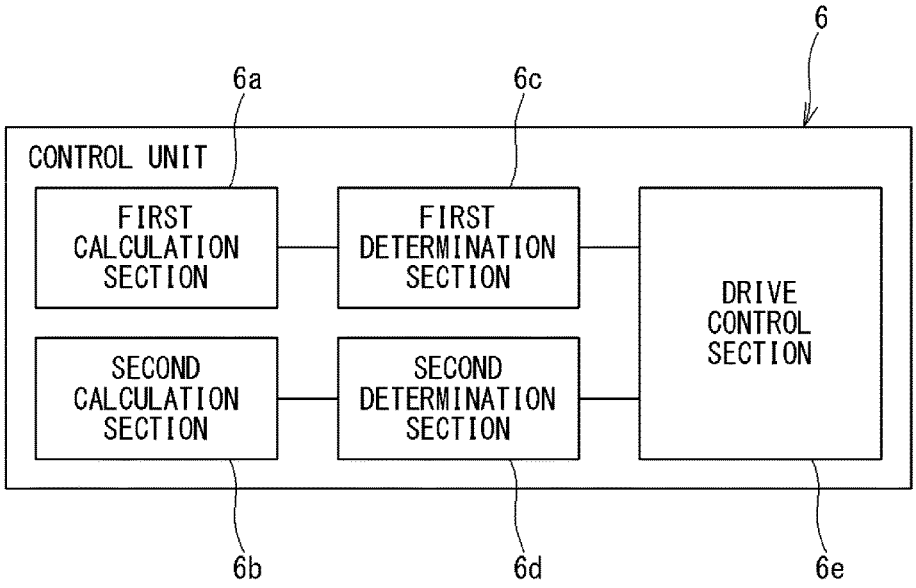
FIG. 5 is a block diagram showing the internal configuration of a control unit.

FIG. 5 is a block diagram showing the internal configuration of the control unit 6. The control unit 6 includes first and second calculation sections 6*a* and 6*b*, first and second determination sections 6*c* and 6*d*, and a drive control section 6*e*.

The first calculation section 6*a* calculates a first expansion time from the most contracted state of the first bellows 13 to the most expanded state of the first bellows 13 and a first contraction time from the most expanded state of the first bellows 13 to the most contracted state of the first bellows 13, on the basis of the respective detection signals of the pair of proximity sensors 29A and 29B. Specifically, the first calculation section 6*a* calculates, as the first expansion time, an elapsed time from a time point of end of detection by the proximity sensor 29A to a time point of detection by the proximity sensor 29B. In addition, the first calculation section 6*a* calculates, as the first contraction time, an elapsed time from a time point of end of detection by the proximity sensor 29B to a time point of detection by the proximity sensor 29A.

The second calculation section 6*b* calculates a second expansion time from the most contracted state of the second bellows 14 to the most expanded state of the second bellows 14 and a second contraction time from the most expanded state of the second bellows 14 to the most contracted state of the second bellows 14, on the basis of the respective detection signals of the pair of proximity sensors 31A and 31B. Specifically, the second calculation section 6*b* calculates, as the second expansion time, an elapsed time from a time point of end of detection by the proximity sensor 31A to a time point of detection by the proximity sensor 31B. In addition, the second calculation section 6*b* calculates, as the second contraction time, an elapsed time from a time point of end of detection by the proximity sensor 31B to a time point of detection by the proximity sensor 31A.

On the basis of the calculated first expansion time and first contraction time, the first determination section 6*c* determines a first time difference from a time point at which the first bellows 13 in the most expanded state starts contraction operation to a time point at which the second bellows 14 in the most expanded state starts contraction operation before the first bellows 13 comes into the most contracted state through the contraction operation.

The first determination section 6*c* of the present embodiment determines the first time difference, for example, by using the following equation (1).

$$\text{First time difference}=(\text{first expansion time}+\text{first contraction time})/2 \quad (1)$$

On the basis of the calculated second expansion time and second contraction time, the second determination section 6*d* determines a second time difference from a time point at which the second bellows 14 in the most expanded state starts contraction operation to a time point at which the first bellows 13 in the most expanded state starts contraction operation before the second bellows 14 comes into the most contracted state through the contraction operation.

The second determination section 6*d* of the present embodiment determines the second time difference, for example, by using the following equation (2).

$$\text{Second time difference}=(\text{second expansion time}+\text{second contraction time})/2 \quad (2)$$

On the basis of the determined first and second time differences, the drive control section 6*e* controls drive of the first and second driving devices. Specifically, the drive control section 6*e* controls drive of the first and second air cylinder portions 27 and 28 such that: contraction operation of the second bellows 14 in the most expanded state is started at a time point at which the first time difference elapses from a time point at which the first bellows 13 in the most expanded state starts contraction operation; and contraction operation of the first bellows 13 in the most expanded state is started at a time point at which the second time difference elapses from a time point at which the second bellows 14 in the most expanded state starts contraction operation.

The bellows pump device BP shown in FIG. 1 further includes a power switch 8, a start switch 9, and a stop switch 10.

The power switch 8 outputs an operation command for powering on/off the bellows pump 1, and the operation command is inputted to the control unit 6. The start switch 9 outputs an operation command for driving the bellows pump 1, and the operation command is inputted to the control unit 6. The stop switch 10 outputs an operation command for causing a standby state where both the first bellows 13 and the second bellows 14 are in the most contracted state.

<Control of Drive of Bellows Pump>

Figure 6:
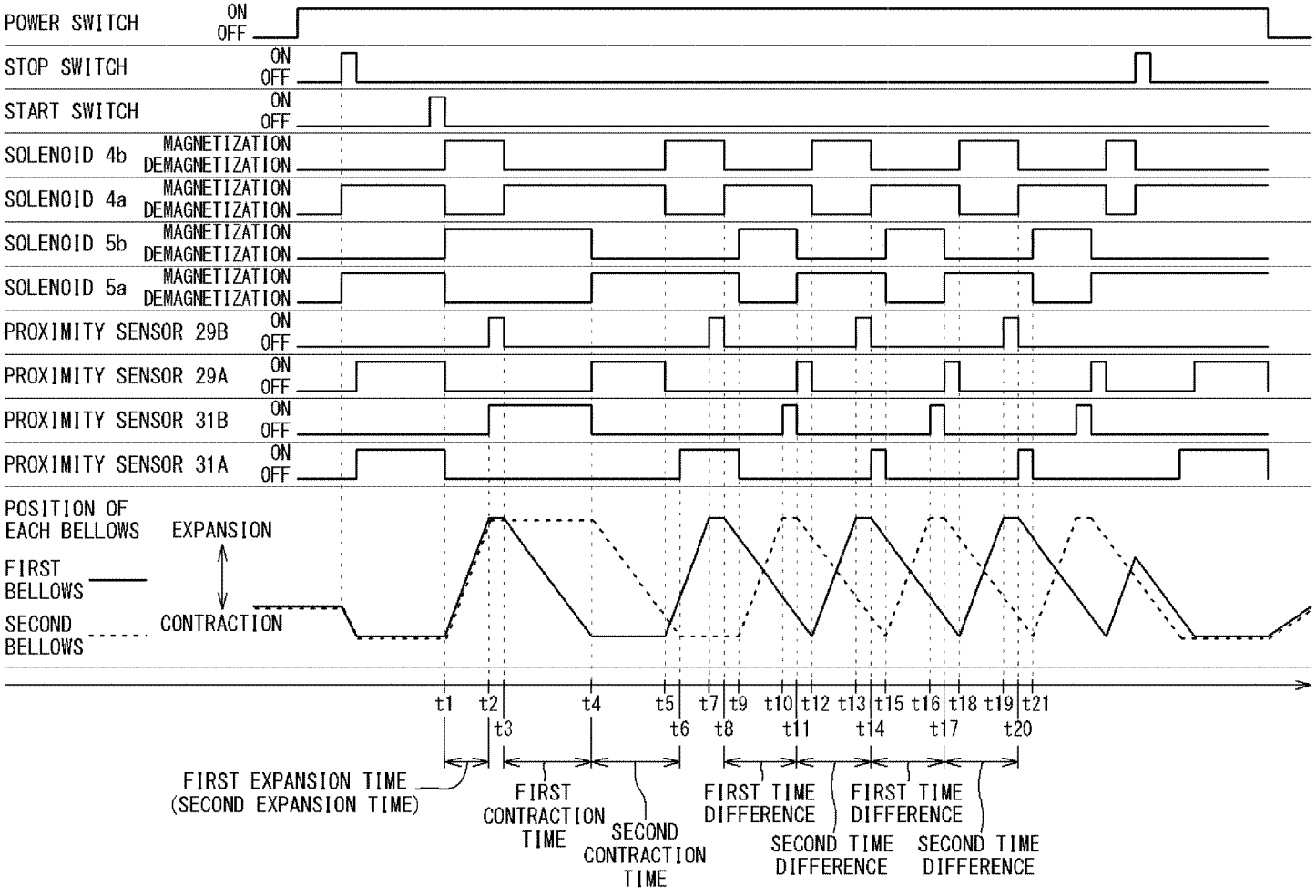
FIG. 6 is a time chart showing an example of drive control of the bellows pump.

FIG. 6 is a time chart showing an example of control of drive of the bellows pump 1 by the control unit 6. When the power switch 8 is OFF, the first and second switching valves 4 and 5 (see FIG. 1) are maintained at the neutral positions thereof. Therefore, when the power switch 8 is OFF, the air chambers 21 and 26 of the first and second air cylinder portions 27 and 28 of the bellows pump 1 communicate with the atmosphere. Thus, the first bellows 13 and the second bellows 14 are maintained at positions expanded slightly from the standby state, such that the interiors of both air chambers 21 and 26 are balanced with the atmospheric pressure.

In starting drive of the bellows pump 1, the power switch 8 is turned on by an operator, and then the stop switch 10 is turned by the operator to move the first bellows 13 and the second bellows 14 until the standby state. Specifically, the drive control section 6*e* magnetizes the solenoid 4*a* of the first switching valve 4 and the solenoid 5*a* of the second switching valve 5 to cause the first bellows 13 and the second bellows 14 to simultaneously contract until the most contracted state. Accordingly, the first bellows 13 and the second bellows 14 are maintained in the standby state. In the standby state, the proximity sensors 29A and 31A are in ON states of detecting the detection plates 30 and 32, respectively.

Next, when the start switch 9 is turned on by the operator, the drive control section 6*e* initially executes control for calculating the first expansion time and the first contraction time of the first bellows 13 and the second expansion time and the second contraction time of the second bellows 14.

Specifically, the drive control section 6*e* demagnetizes the solenoid 4*a* of the first switching valve 4 and also magnetizes the solenoid 4*b* to cause the first bellows 13 to expand from the most contracted state (standby state) to the most expanded state. At the same time with this, the drive control section 6*e* demagnetizes the solenoid 5*a* of the second switching valve 5 and also magnetizes the solenoid 5*b* to also cause the second bellows 14 to expand from the most contracted state (standby state) to the most expanded state.

When the first bellows 13 expands from the most contracted state to the most expanded state, the first calculation section 6*a* counts a time from a time point (t1) at which the proximity sensor 29A becomes OFF to a time point (t2) at which the proximity sensor 29B becomes ON, to calculate the first expansion time (t2–t1) of the first bellows 13.

Similarly, when the second bellows 14 expands from the most contracted state to the most expanded state, the second calculation section 6*b* counts a time from a time point (t1) at which the proximity sensor 31A becomes OFF to a time point (t2) at which the proximity sensor 31B becomes ON, to calculate the second expansion time (t2–t1) of the second bellows 14.

Next, after a predetermined time (t3–t2) elapses, the drive control section 6*e* demagnetizes the solenoid 4*b* of the first switching valve 4 and also magnetizes the solenoid 4*a* to cause only the first bellows 13 to contract from the most expanded state to the most contracted state.

At this time, the first calculation section 6*a* counts a time from a time point (t3) at which the proximity sensor 29B becomes OFF to a time point (t4) at which the proximity sensor 29A becomes ON, to calculate the first contraction time (t4–t3) of the first bellows 13.

Then, at the first determination section 6*c*, the first time difference is determined on the bases of the calculated first expansion time and first contraction time. In the present embodiment, the first determination section 6*c* calculates the first time difference by using the following equation (3).

$$\text{First time difference}=(\text{first expansion time}+\text{first contraction time})/2=((t2-t1)+(t4-t3))/2 \quad (3)$$

Next, at the same time as a time point (t4) at which the first bellows 13 contracts to the most contracted state, the drive control section 6*e* demagnetizes the solenoid 5*b* of the second switching valve 5 and also magnetizes the solenoid 5*a* to cause the second bellows 14 to contract from the most expanded state to the most contracted state.

At this time, the second calculation section 6*b* counts a time from a time point (t4) at which the proximity sensor 31B becomes OFF to a time point (t6) at which the proximity sensor 31A becomes ON, to calculate the second contraction time (t6–t4) of the second bellows 14.

Then, at the second determination section 6*d*, the second time difference is determined on the basis of the calculated second expansion time and second contraction time. In the present embodiment, the second determination section 6*d* calculates the second time difference by using the following equation (4).

$$\text{Second time difference}=\left(\begin{matrix}\text{second expansion time}+\\ \text{second contraction}\end{matrix}\right)\Big/2 = ((t2-t1)+(t6-t4))/2 \quad (4)$$

Thereafter, each time the first bellows 13 performs a one-round-trip operation, the first expansion time and the first contraction time are calculated by the first calculation section 6*a*, and the first time difference is determined on the basis of the calculated first expansion time and the first contraction time by the first determination section 6*c*, as described above.

Similarly, each time the second bellows 14 performs a one-round-trip operation, the second expansion time and the second contraction time are calculated by the second calculation section 6*b*, and the second time difference is determined on the basis of the calculated second expansion time and second contraction time by the second determination section 6*d*, as described above.

Meanwhile, the drive control section 6*e* starts drive of the first bellows 13 before the second bellows 14 comes into the most contracted state. Specifically, at a time point (t5) before the second bellows 14 comes into the most contracted state, the drive control section 6*e* demagnetizes the solenoid 4*a* of the first switching valve 4 and also magnetizes the solenoid 4*b*. Accordingly, the first bellows 13 starts expansion operation from the most contracted state.

After a predetermined time (t6–t5) from the time point at which the first bellows 13 starts expansion operation, the second bellows 14 comes into the most contracted state, and the proximity sensor 31A is switched from OFF to ON, but the drive control section 6*e* continues to maintain the second bellows 14 in the most contracted state for a while.

Thereafter, when the proximity sensor 29B is switched from OFF to ON at a time point (t7) at which the first bellows 13 comes into the most expanded state, the drive control section 6*e* demagnetizes the solenoid 4*b* of the first switching valve 4 and also magnetizes the solenoid 4*a* after a predetermined time (t8–t7) elapses. Accordingly, the first bellows 13 starts contraction operation from the most expanded state.

In addition, from a time point (t8) at which the solenoid 4*a* is magnetized, the drive control section 6*e* start counting the first time difference determined above.

Then, when a predetermined time (t9–t8) elapses from the time point at which the first bellows 13 starts contraction operation, the drive control section 6*e* demagnetizes the solenoid 5*a* of the second switching valve 5 and also magnetizes the solenoid 5*b*. Accordingly, while the first bellows 13 performs contraction operation, the second bellows 14 expands from the most contracted state to the most expanded state.

At this time, at a time point (t10) at which the second bellows 14 comes into the most expanded state, the proximity sensor 31B is switched from OFF to ON, but the drive control section 6*e* continues to maintain the second bellows 14 in the most expanded state.

Figure 8:
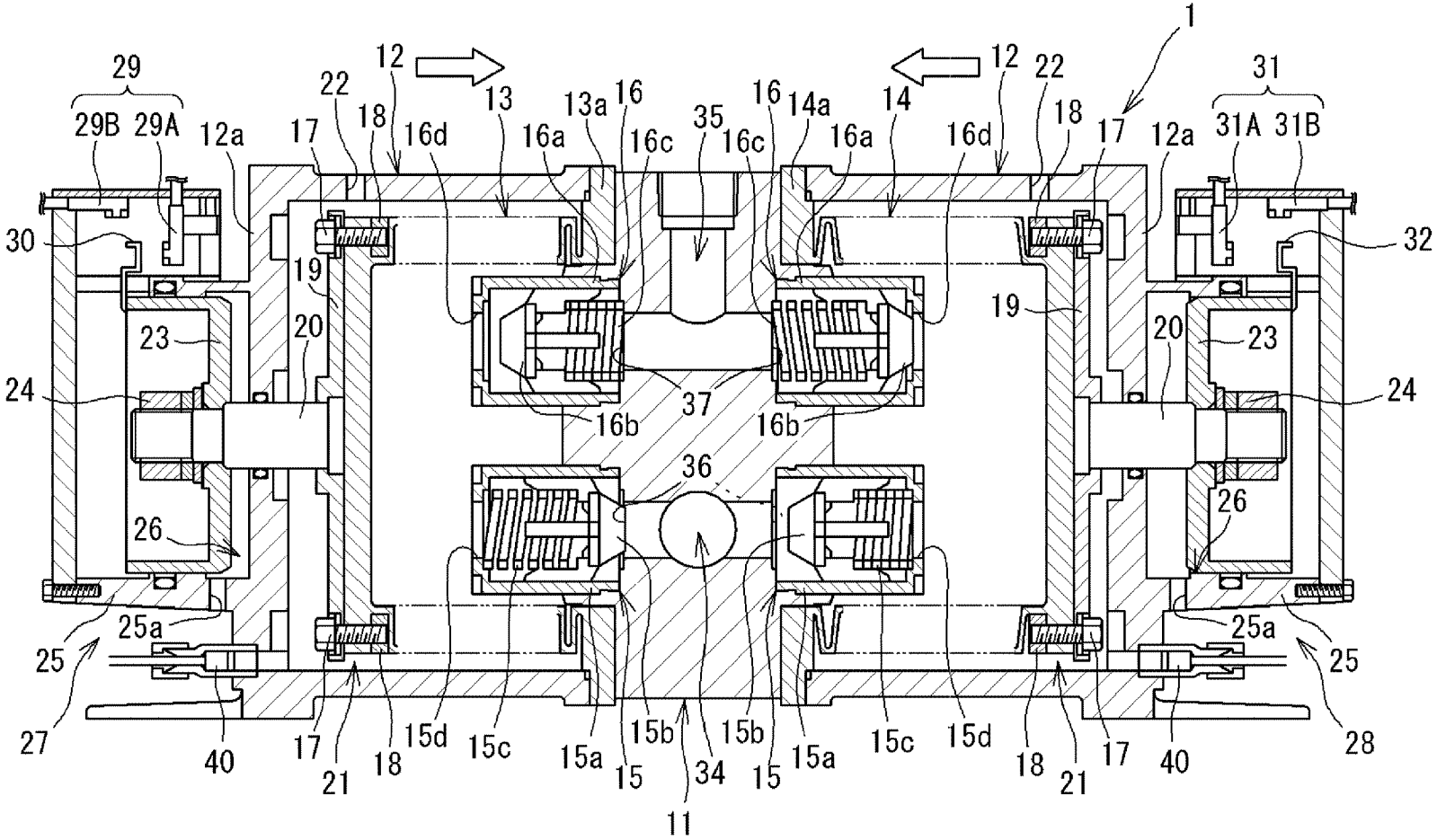
FIG. 8 is a cross-sectional view showing a state where the first bellows in a most expanded state has started contracting before the second bellows comes into a most contracted state.

Next, when the first time difference (t11–t8) elapses, the drive control section 6*e* demagnetizes the solenoid 5*b* of the second switching valve 5 and also magnetizes the solenoid 5*a*. Accordingly, before the first bellows 13 comes into the most contracted state, the second bellows 14 starts contraction operation from the most expanded state (see FIG. 8).

In addition, at a time point (t11) at which the solenoid 5*a* is magnetized, the drive control section 6*e* starts counting the second time difference determined above.

After the second bellows 14 starts contraction operation, when the proximity sensor 29A is switched from OFF to ON at a time point (t12) at which the first bellows 13 comes into the most contracted state, the drive control section 6*e* demagnetizes the solenoid 4*a* of the first switching valve 4 and also magnetizes the solenoid 4*b*. Accordingly, while the second bellows 14 performs contraction operation, the first bellows 13 expands from the most contracted state to the most expanded state.

At this time, at a time point (t13) at which the first bellows 13 comes into the most expanded state, the proximity sensor 29B is switched from OFF to ON, but the drive control section 6*e* continues to maintain the first bellows 13 in the most expanded state.

Figure 7:
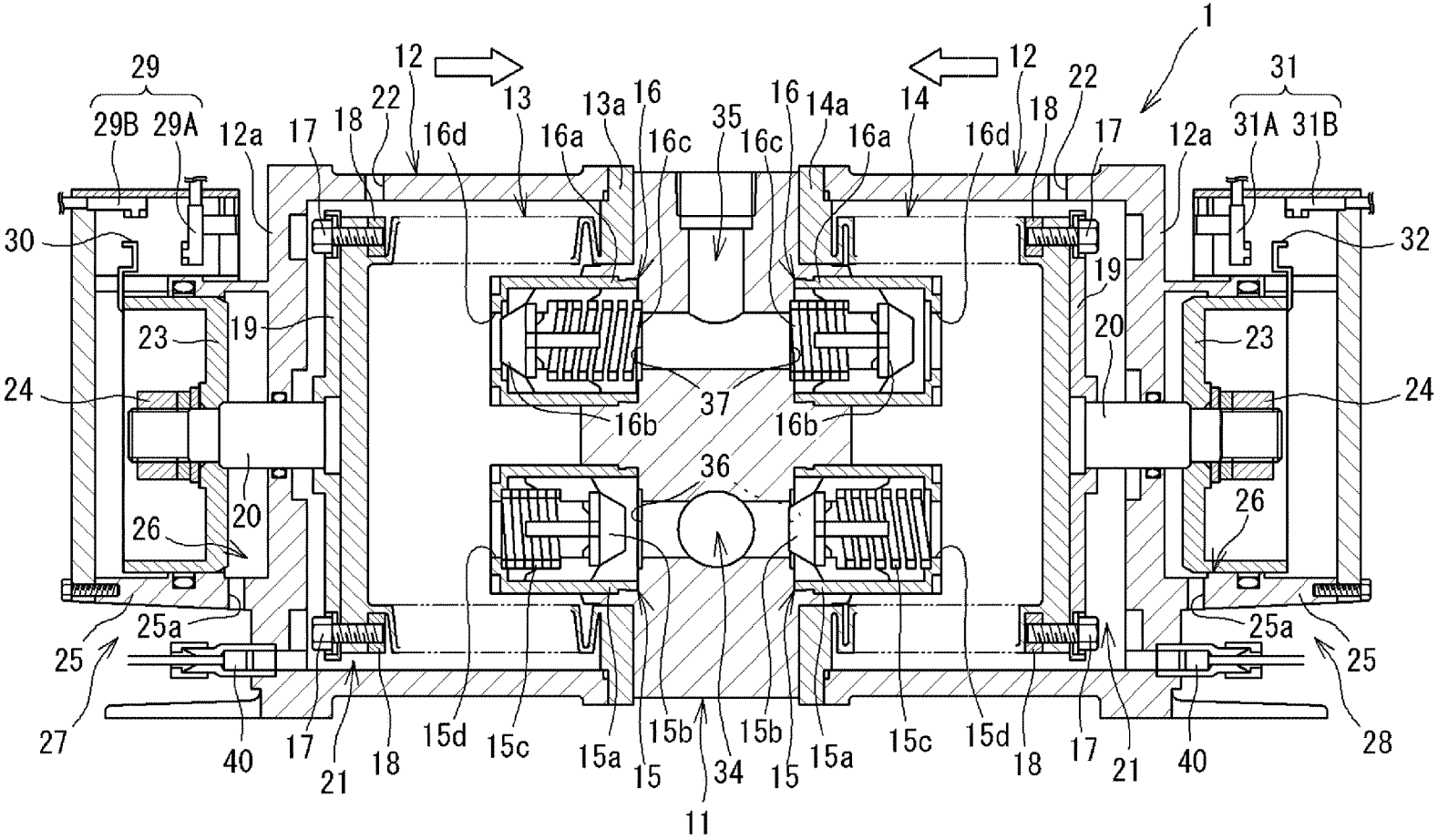
FIG. 7 is a cross-sectional view showing a state where a second bellows in a most expanded state has started contracting before a first bellows comes into a most contracted state.

Next, when the second time difference (t14–t11) elapses, the drive control section 6*e* demagnetizes the solenoid 4*b* of the first switching valve 4 and also magnetizes the solenoid 4*a*. Accordingly, before the second bellows 14 comes into the most contracted state, the first bellows 13 starts contraction operation from the most expanded state (see FIG. 7).

In addition, from a time point (t14) at which the solenoid 4*a* is magnetized, the drive control section 6*e* starts counting the first time difference determined immediately before. The first time difference determined immediately before is a time difference determined on the basis of the first expansion time (t7–t5) and the first contraction time (t12–t8) calculated as a result of an immediately-previous one-round-trip operation of the first bellows 13.

After the first bellows 13 starts contraction operation, when the proximity sensor 31A is switched from OFF to ON at a time point (T15) at which the second bellows 14 comes into the most contracted state, the drive control section 6*e* demagnetizes the solenoid 5*a* of the second switching valve 5 and also magnetizes the solenoid 5*b*. Accordingly, while the first bellows 13 performs contraction operation, the second bellows 14 expands from the most contracted state to the most expanded state.

At this time, at a time point (t16) at which the second bellows 14 comes into the most expanded state, the proximity sensor 31B is switched from OFF to ON, but the drive control section 6*e* continues to maintain the second bellows 14 in the most expanded state.

Next, when the above first time difference (t17–t14) determined immediately before elapses, the drive control section 6*e* demagnetizes the solenoid 5*b* of the second switching valve 5 and also magnetizes the solenoid 5*a*. Accordingly, before the first bellows 13 comes into the most contracted state, the second bellows 14 starts contraction operation from the most expanded state.

In addition, from a time point (t17) at which the solenoid 5*a* is magnetized, the drive control section 6*e* starts counting the second time difference determined immediately before. The second time difference determined immediately before is a time difference determined on the basis of the second expansion time (t10–t9) and the second contraction time (t15–t11) calculated as a result of an immediately-previous one-round-trip operation of the second bellows 14.

After the second bellows 14 starts contraction operation, when the proximity sensor 29A is switched from OFF to ON at a time point (t18) at which the first bellows 13 comes into the most contracted state, the drive control section 6*e* demagnetizes the solenoid 4*a* of the first switching valve 4 and also magnetizes the solenoid 4*b*. Accordingly, while the second bellows 14 performs contraction operation, the first bellows 13 expands from the most contracted state to the most expanded state.

At this time, at a time point (t19) at which the first bellows 13 comes into the most expanded state, the proximity sensor 29B is switched from OFF to ON, but the drive control section 6*e* continues to maintain the first bellows 13 in the most expanded state.

Next, when the above second time difference (t20–t17) determined immediately before elapses, the drive control section 6*e* demagnetizes the solenoid 4*b* of the first switching valve 4 and also magnetizes the solenoid 4*a*. Accordingly, before the second bellows 14 comes into the most contracted state, the first bellows 13 starts contraction operation from the most expanded state.

Thereafter, the drive control section 6*e* controls drive of the bellows pump 1 such that, as described above, on the basis of the first and second time differences determined immediately before, the first bellows 13 is caused to contract from the most expanded state before the second bellows 14 comes into the most contracted state, and the second bellows 14 is caused to contract from the most expanded state before the first bellows 13 comes into the most contracted state.

Therefore, even when the first and second contraction time (discharge times) and the first and second expansion times (suction times) vary due to a discharge load of the transport fluid or the like, drive of the bellows pump 1 can be controlled at optimum timing so as to follow the variation.

In the present embodiment, although the first and second time differences determined immediately before are used, drive of the bellows pump 1 may be controlled by using the first and second time differences initially determined immediately after start of operation, when there is no variation in the above discharge times and suction times. In this case, switching between the expansion operation and the contraction operation of the first and second bellows 13 and 14 may be performed every predetermined time by using a timer or the like, not by using the proximity sensors 29A, 29B, 31A, and 31B.

In stopping drive of the bellows pump 1, first, the stop switch 10 is turned on by the operator. The drive control section 6*e* that has received this operation signal moves the first bellows 13 and the second bellows 14 into the standby state. At this time, when either one of the first bellows 13 and the second bellows 14 is performing expansion operation, the drive control section 6*e* stops the expansion operation and immediately causes the either one of the first bellows 13 and the second bellows 14 to start contraction operation. Then, when the first bellows 13 and the second bellows 14 come into the standby state, the power switch 8 is turned off by the operator.

Before one bellows 13 (14) comes into the most contracted state, the control unit 6 of the present embodiment causes the other bellows 14 (13) to contract from the most expanded state. However, the control unit 6 may perform control such that, when the one bellows 13 (14) comes into the most contracted state, the other bellows 14 (13) is caused to contract from the most expanded state. From the standpoint of reducing pulsation at the discharge side of the bellows pump 1, control is preferably performed as in the present embodiment.

<Configurations of Electropneumatic Regulators>

In FIGS. 1 and 2, the first electropneumatic regulator 51 is disposed between the mechanical regulator 3 and the first switching valve 4. In addition, the second electropneumatic regulator 52 is disposed between the mechanical regulator 3 and the second switching valve 5. Each of the electropneumatic regulators 51 and 52 has a function to steplessly adjust the air pressure outputted from an output port (not shown), on the basis of a set pressure that is externally preset.

During contraction of the first bellows 13, the first electropneumatic regulator 51 of the present embodiment adjusts the air pressure of the pressurized air to be supplied to the discharge-side air chamber 21 of the first air cylinder portion 27, such that the air pressure is increased so as to correspond to the contraction characteristic of the first bellows 13.

In addition, during contraction operation of the second bellows 14, the second electropneumatic regulator 52 adjusts the air pressure of the pressurized air to be supplied to the discharge-side air chamber 21 of the second air cylinder portion 28, such that the air pressure is increased so as to correspond to the contraction characteristic of the second bellows 14.

<Control of Electropneumatic Regulators>

Figure 9:
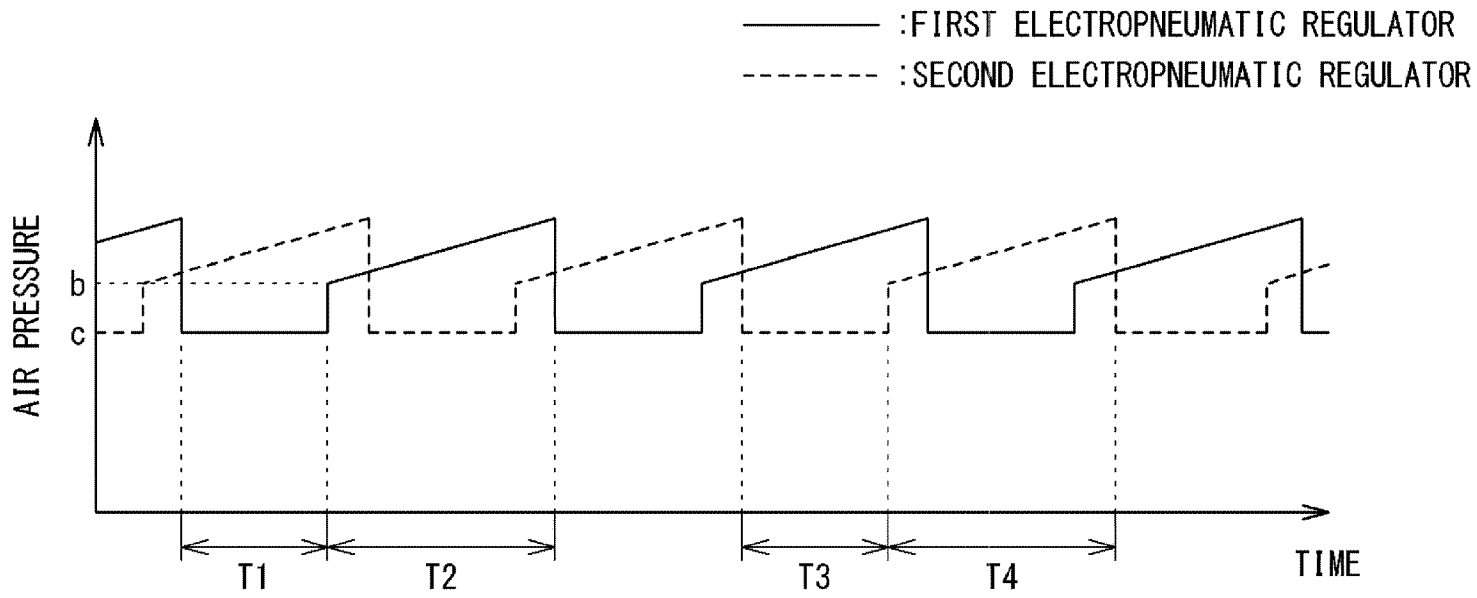
FIG. 9 is a graph showing an example of adjustment of an air pressure by first and second electropneumatic regulators.

FIG. 9 is a graph showing an example of adjustment of the air pressure by the first and second electropneumatic regulators 51 and 52. In FIG. 9, during an expansion time T1 when the first bellows 13 is expanding (during expansion operation), the first electropneumatic regulator 51 adjusts the air pressure of the pressurized air such that the air pressure is always a constant air pressure c. The air pressure c is instructed from the control unit 6. Then, during a contraction time T2 when the first bellows 13 is contracting (during contraction operation), the first electropneumatic regulator 51 adjusts the air pressure of the pressurized air in accordance with an instruction from the control unit 6 such that the air pressure is an air pressure calculated by the control unit 6 every unit time (e.g., 10 ms) using the following equation (5).

$$P=aX+b \tag{5}$$

P denotes the air pressure of the pressurized air outputted from the output port, a denotes a pressure increase coefficient, X denotes an expansion/contraction position of the first bellows 13, and b denotes the initial air pressure. In the present embodiment, the pressure increase coefficient a indicates the contraction characteristic of the first bellows 13, and the initial air pressure b is set at a value higher than the air pressure c. In addition, for example, where the most expanded state of the first bellows 13 is $X_0$ (=0 mm) as shown in FIG. 3 and the most contracted state of the first bellows 13 is $X_{max}$ as shown in FIG. 4, the expansion/contraction position X is set as a displacement from $X_0$.

Similarly, during an expansion time T3 when the second bellows 14 is expanding (during expansion operation), the second electropneumatic regulator 52 adjusts the air pressure of the pressurized air such that the air pressure is always a constant air pressure c. The air pressure c is instructed from the control unit 6. Then, during a contraction time T4 when the second bellows 14 is contracting (during contraction operation), the second electropneumatic regulator 52 adjusts the air pressure of the pressurized air in accordance with an instruction from the control unit 6 such that the air pressure is an air pressure calculated by the control unit 6 every unit time (e.g., 10 ms) using the above equation (5). In this case, X denotes an expansion/contraction position of the second bellows 14, and the pressure increase coefficient a indicates the contraction characteristic of the second bellows 14.

By using the expansion/contraction position of the bellows 13 (14) as X in the above equation (5) as described above, for example, even when the discharged fluid resistance increases so that the discharge time increases, the value of the pressure increase coefficient a in a look-up table in a second embodiment described later can be used as a fixed value.

In addition, the present expansion/contraction position of the bellows 13 (14) can be calculated, for example, on the basis of a time difference taken from the most expanded state of the bellows 13 (14) to the most contracted state of the bellows 13 (14) and obtained through position measurement in advance. As a matter of course, the present expansion/contraction position of the bellows 13 (14) also can be detected by a displacement sensor or the like.

In the present embodiment, each of the pressure increase coefficient a and the initial air pressures b and c that are used when the air pressure into which adjustment is made by each of the electropneumatic regulators 51 and 52 is calculated in the control unit 6 is set at the same value, but may be set at values different between the respective electropneumatic regulators.

Figure 10:
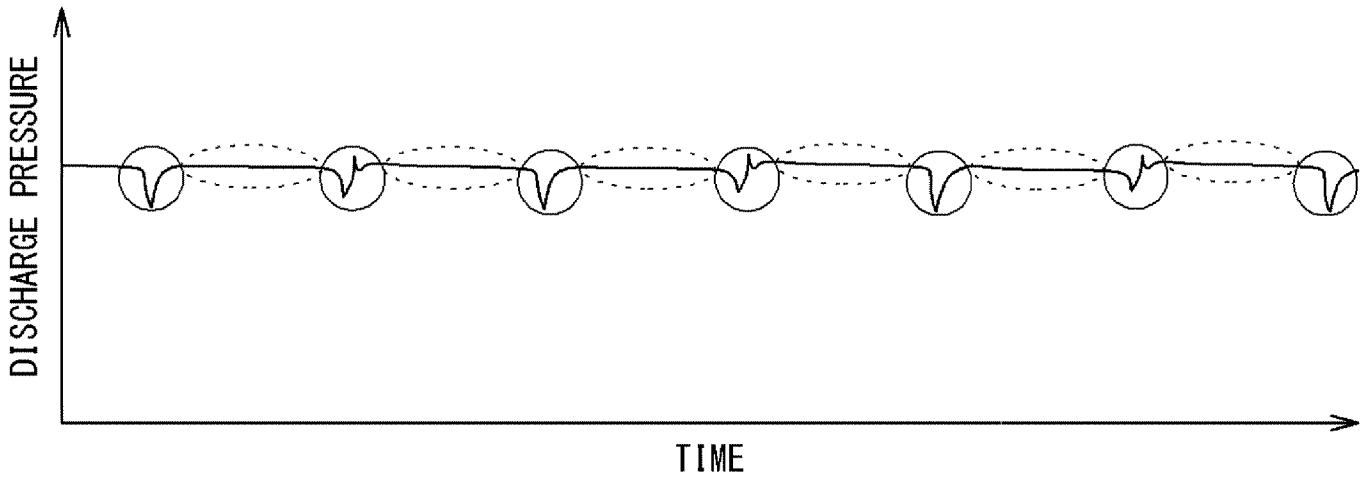
FIG. 10 is a graph showing the discharge pressure of a transport fluid discharged from the bellows pump.

FIG. 10 is a graph showing the discharge pressure of the transport fluid discharged from the bellows pump 1. As shown in FIG. 10, by the first and second electropneumatic regulators 51 and 52 adjusting the air pressure of the pressurized air as described above, fall of the discharge pressure of the transport fluid discharged from the bellows pump 1 can be reduced while each of the bellows 13 and 14 is contracting alone (at portions surrounded by dotted lines in the drawing).

Furthermore, by the drive control section 6*e* controlling drive of the bellows pump 1 on the basis of the first and second time differences as described above, at timing of switching from contraction of one bellows (discharge) to expansion thereof (suction) (at portions surrounded by solid lines in the drawing), the other bellows has already contracted to discharge the transport fluid. Thus, great fall of the discharge pressure at the timing of switching can be reduced.

Therefore, by combining the control by the first and second electropneumatic regulators 51 and 52 and the control by the drive control section 6*e*, pulsation at the discharge side of the bellows pump 1 can be effectively reduced.

As described above, according to the bellows pump device BP of the present embodiment, during contraction operation of the bellows 13 (14), the air pressure of the pressurized air supplied to the discharge-side air chamber 21 is increased by the electropneumatic regulator 51 (52) so as to correspond to the contraction characteristic of the bellows 13 (14), so that the air pressure of the pressurized air in the discharge-side air chamber 21 can be increased as the bellows 13 (14) contracts. Accordingly, fall of the discharge pressure of the transport fluid during contraction of the bellows 13 (14) can be reduced.

In addition, since the electropneumatic regulator 51 (52) adjusts the air pressure every unit time by using the aforementioned equation (5), fall of the discharge pressure of the transport fluid during contraction of the bellows 13 (14) can be effectively reduced.

In addition, the first bellows 13 and the second bellows 14 are made expandable/contractible independently of each other, and the control unit 6 is configured to perform drive control such that the second bellows 14 is caused to contract from the most expanded state before the first bellows 13 comes into the most contracted state, and the first bellows 13 is caused to contract from the most expanded state before the second bellows 14 comes into the most contracted state. Thus, the following advantageous effects are achieved. Specifically, at timing of switching from contraction of one bellows (discharge) to expansion thereof (suction), the other bellows has already contracted to discharge the transport fluid. Thus, great fall of the discharge pressure at the timing of switching can be reduced. As a result, pulsation at the discharge side of the bellows pump 1 can be reduced.

In addition, the bellows pump device BP of the present embodiment does not need to ensure a space for installing another member (accumulator) other than the bellows pump, as compared to a bellows pump device having an accumulator mounted at the discharge side of a bellows pump. Thus, a substantial increase in an installation space can be suppressed. Furthermore, since the bellows pump device BP of the present embodiment discharges the transport fluid by using a pair of the bellows 13 and 14 similarly to a conventional bellows pump having a pair of bellows connected to each other by a tie rod, the amount of the fluid discharged does not decrease.

The control unit 6 is able to perform drive control so as to use the first time difference determined on the basis of the first expansion time and the first contraction time of the first bellows 13, to cause the second bellows 14 in the most expanded state to contract before the first bellows 13 comes into the most contracted state, and also so as to use the second time difference determined on the basis of the second expansion time and the second contraction time of the second bellows 14, to cause the first bellows 13 in the most expanded state to contract before the second bellows 14 comes into the most contracted state. Accordingly, the second bellows can be assuredly caused to contract before the first bellows comes into the most contracted state, and also the first bellows can be assuredly caused to contract before the second bellows comes into the most contracted state.

Immediately after start of operation of the bellows pump 1, the control unit 6 calculates the expansion times and the contraction times of the first and second bellows 13 and 14 beforehand, and performs drive control. Thus, even when these expansion times and these contraction times are not known before start of operation, the second bellows 14 (first bellows 13) can be assuredly caused to contract before the first bellows 13 (second bellows 14) comes into the most contracted state.

The control unit 6 performs drive control on the basis of the first and second time differences determined immediately before. Thus, even when the first expansion time and the first contraction time of the first bellows 13 (the second expansion time and the second contraction time of the second bellows 14) vary, the second bellows 14 (first bellows 13) can be assuredly caused to contract so as to follow the variation, before the first bellows 13 (second bellows 14) comes into the most contracted state.

<Modification>

Figure 11:
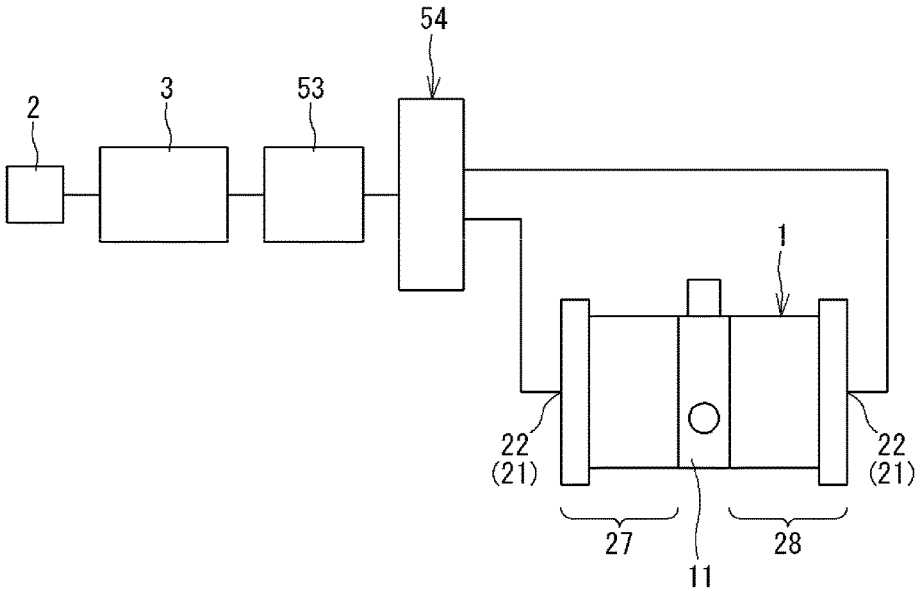
FIG. 11 is a schematic configuration diagram showing a modification of the bellows pump device according to the first embodiment.

FIG. 11 is a schematic configuration diagram showing a modification of the bellows pump device according to the above embodiment. In the bellows pump device BP according to the present modification, similarly as in the conventional art, a pair of right and left bellows are integrally connected to each other by a tie rod, which is not shown, and only the discharge-side air chamber 21 and the suction/exhaust port 22 are formed in each of the air cylinder portions 27 and 28.

Accordingly, when the pressurized air is supplied to one discharge-side air chamber 21, the corresponding bellows contracts, so that the transport fluid is discharged. At the same time, the other bellows forcedly expands, so that the transport fluid is sucked from the suction passage. In addition, when the pressurized air is supplied to the other discharge-side air chamber 21, the other bellows contracts, so that the transport fluid is discharged. At the same time, the one bellows forcedly expands, so that the transport fluid is sucked.

Each suction/exhaust port 22 is connected to the air supply device 2 via a single switching valve 54, a single electropneumatic regulator 53, and the mechanical regulator 3.

The switching valve 54 switches between supply and discharge of the pressurized air by magnetizing or demagnetizing a pair of solenoids that are not shown, such that the pressurized air is supplied to one of the discharge-side air chambers 21 of both air cylinder portions 27 and 28 and the pressurized air is discharged from the other of the discharge-side air chambers 21.

During contraction operation of each bellows, the electropneumatic regulator 53 adjusts the air pressure of the pressurized air to be supplied to the corresponding discharge-side air chamber 21, such that the air pressure is increased so as to correspond to the contraction characteristic of the bellows that contracts. The details thereof are the same as in the above embodiment, and thus the description thereof is omitted.

[Second Embodiment]

<Entire Configuration of System>

Figure 12:
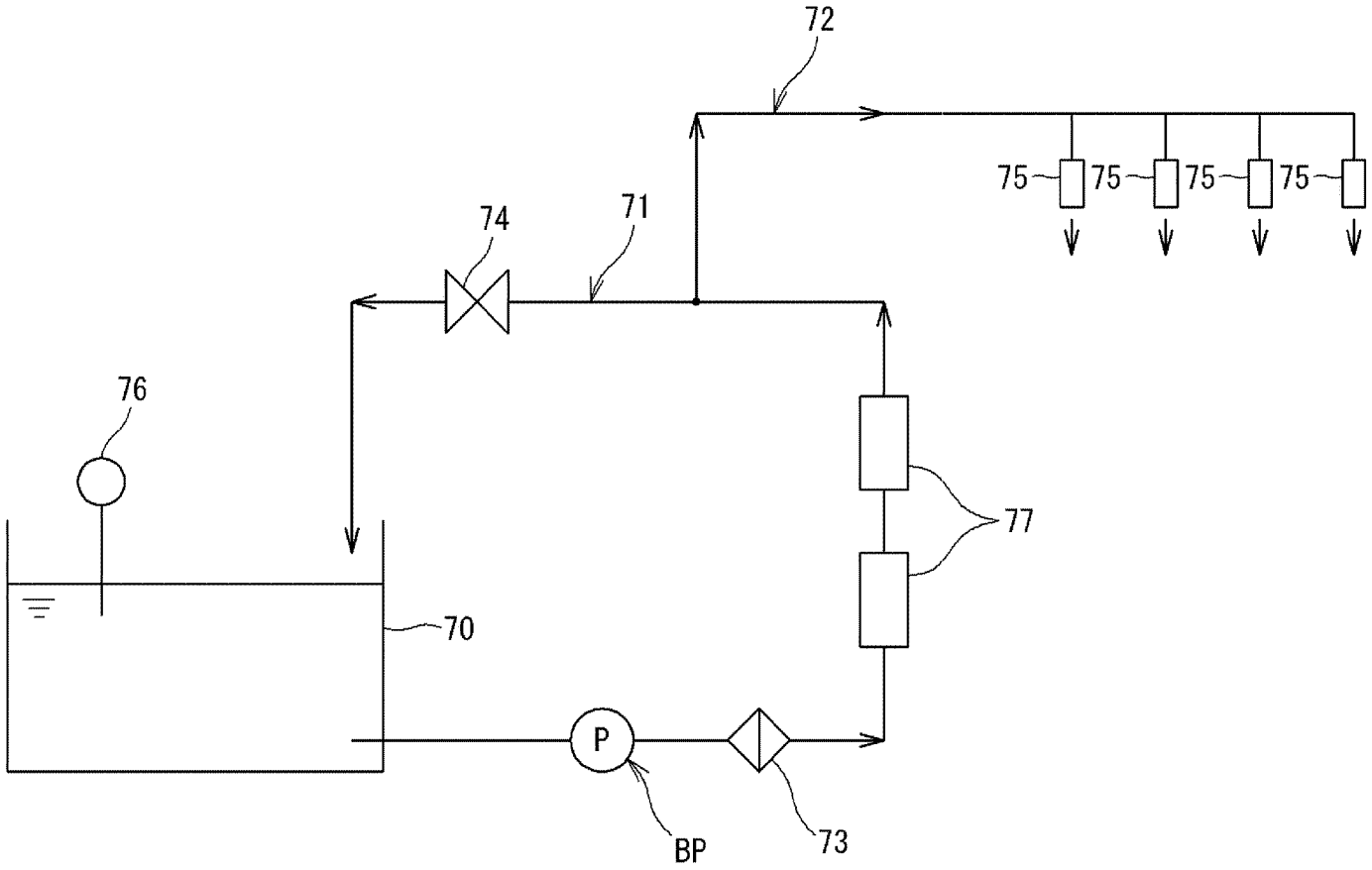
FIG. 12 is a schematic diagram showing the configuration of a fluid feeding system including a bellows pump device according to a second embodiment of the present invention.

FIG. 12 is a schematic diagram showing the configuration of a fluid feeding system including a bellows pump device according to the second embodiment of the present invention. The fluid feeding system feeds a transport fluid such as a chemical solution, a solvent, or the like in a certain amount, for example, in a semiconductor production apparatus. The fluid feeding system includes: a tank 70 for storing the transport fluid; a circulation passage 71 through which the transport fluid stored in the tank 70 is fed to the outside and returned to the tank 70; a plurality of supply passages 72 that branch from a middle portion of the circulation passage 71 and through which the transport fluid is supplied to a wafer that is not shown; and a bellows pump device BP that feeds the transport fluid from the tank 70.

On the circulation passage 71, a filter 73 is provided at the downstream side of the bellows pump device BP. In addition, on the circulation passage 71, an opening/closing valve 74 for opening/closing the circulation passage 71 is provided at the downstream side with respect to branch points with the supply passages 72.

Each supply passage 72 is provided with a plurality of nozzles 75 for spraying the transport fluid.

The fluid feeding system further includes a temperature sensor 76 for detecting the temperature of the transport fluid within the tank 70 and a plurality of (two in the illustrated example) heaters 77 disposed at the middle portion of the circulation passage 71.

The heaters 77 heat the transport fluid within the circulation passage 71 on the basis of the temperature of the transport fluid detected by the temperature sensor 76. Accordingly, the temperature of the transport fluid sprayed from the nozzles 75 via the supply passages 72 from the circulation passage 71 can be maintained at an appropriate temperature.

The temperature sensor 76 is provided at the tank 70, but may be provided at the middle portion of the circulation passage 71 or at a middle portion of each supply passage 72.

<Control of Electropneumatic Regulators>

Figure 13:
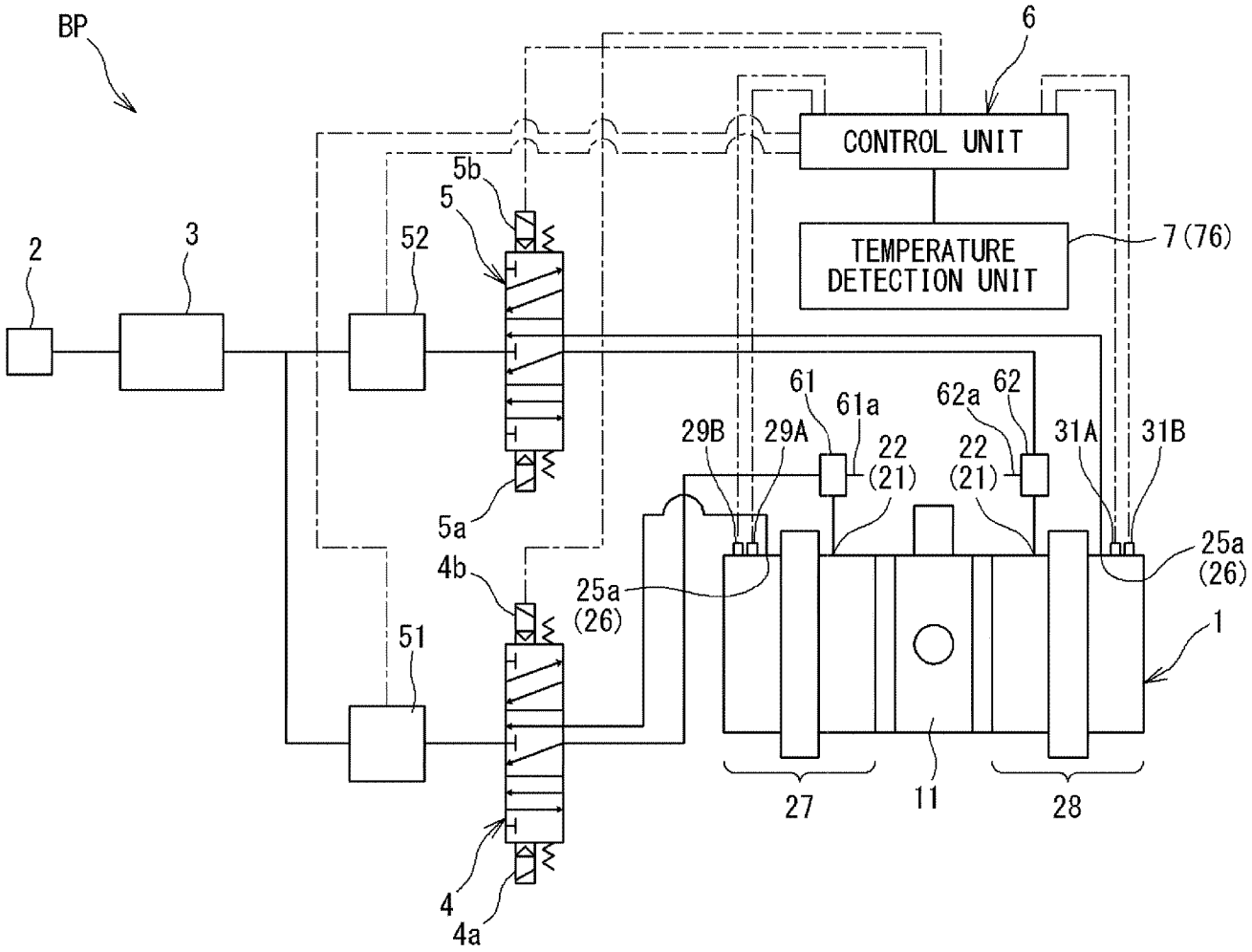
FIG. 13 is a schematic configuration diagram of the bellows pump device of the second embodiment.

FIG. 13 is a schematic configuration diagram of the bellows pump device BP of the second embodiment.

In FIG. 13, the control unit 6 of the present embodiment controls the respective electropneumatic regulators 51 and 52 on the basis of the temperature of the transport fluid detected by a temperature detection unit 7. In the present embodiment, the above temperature sensor 76 (see FIG. 12) for adjusting the temperature of the transport fluid within the circulation passage 71 is used as the temperature detection unit 7. Therefore, the control unit 6 of the present embodiment controls the respective electropneumatic regulators 51 and 52 on the basis of a detection value of the temperature sensor 76.

In the present embodiment, the temperature sensor 76 for adjusting the temperature of the transport fluid within the circulation passage 71 is used as the temperature detection unit 7 for controlling the electropneumatic regulators 51 and 52, but a temperature sensor dedicated for detecting the temperature of the transport fluid may be provided to the bellows pump 1.

The control unit 6 of the present embodiment controls the respective electropneumatic regulators 51 and 52 such that, as the detection value of the temperature sensor 76 decreases, the pressure increase coefficient a used in increasing the air pressure of the pressurized air increases. Specifically, the control unit 6 has a look-up table in which the pressure increase coefficient a is set so as to correspond to each of a plurality of temperature ranges, and instructs an air pressure into which adjustment is made by each of the electropneumatic regulators 51 and 52, with respect to each of the electropneumatic regulators 51 and 52 on the basis of the look-up table.

FIG. 14 is an example of a look-up table 6*f* of the control unit 6. The look-up table 6*f* of the present embodiment indicates pressure increase coefficients a1, a2, and a3 corresponding to three temperature ranges, that is, a low temperature range (10 to 20° C.), an intermediate temperature range (20 to 60° C.), and a high temperature range (60 to 80° C.), respectively. Each of the pressure increase coefficients a1 to a3 is a coefficient determined experimentally, and is set so as to meet a relationship of a1>a2>a3.

The control unit 6 of the present embodiment controls the respective electropneumatic regulators 51 and 52 by using the look-up table method, but may calculate a pressure increase coefficient by using a calculation formula from the detection value of the temperature sensor 76 or the like. In addition, four or more temperature ranges may be set.

Figure 15:
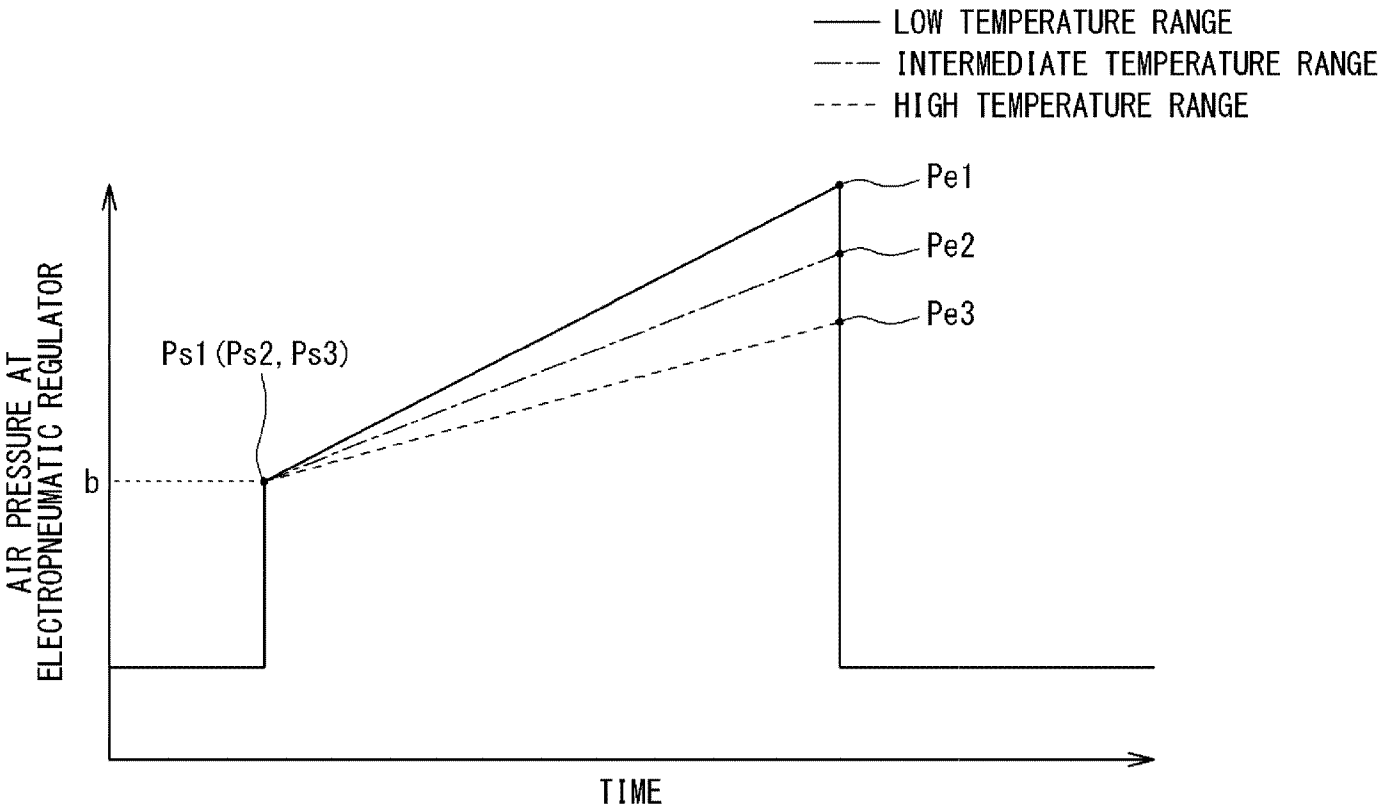
FIG. 15 is a graph showing change of an air pressure at an electropneumatic regulator controlled by a control unit, corresponding to each of a plurality of temperature ranges in the second embodiment.

FIG. 15 is a graph showing change of the air pressure at the electropneumatic regulator 51 (52) controlled by the control unit 6, corresponding to each of the plurality of temperature ranges. As shown in FIG. 15, start air pressures Ps1, Ps2, and Ps3 at a time point of start of contraction of the bellows 13 (14), corresponding to the low temperature range, the intermediate temperature range, and the high temperature range, respectively, are set at an initial air pressure b that is the same value.

Then, regarding the air pressures corresponding to the respective temperature ranges, as the bellows 13 (14) contracts, the pressure differences therebetween increase due to the differences between the pressure increase coefficients a1 to a3 (the gradients of increase straight lines), and the air pressure has a higher value as the temperature range is lower.

The start air pressures Ps1 to Ps3 corresponding to the respective temperature ranges may be set at values different from each other, for example, a higher value is set as the temperature range is lower.

Figure 16:
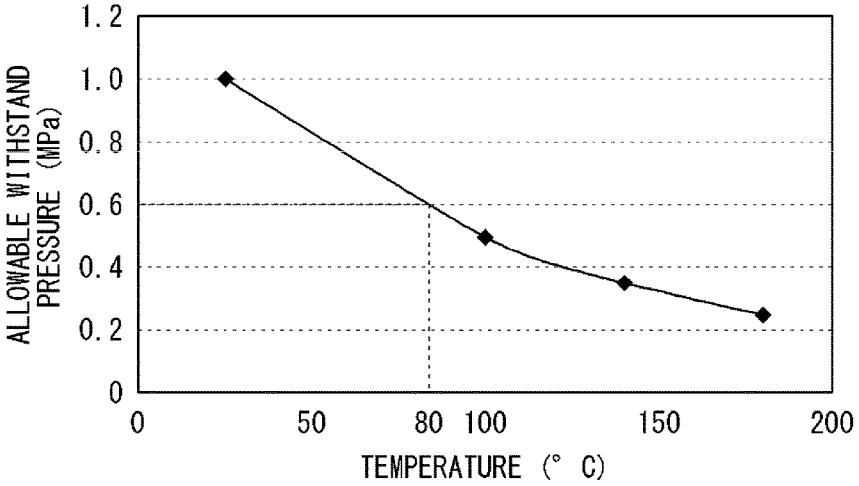
FIG. 16 is a graph showing a relationship between the temperature of a transport fluid and an allowable withstand pressure of a bellows in the second embodiment.

FIG. 16 is a graph showing a relationship between the temperature of the transport fluid and an allowable withstand pressure of the bellows 13 (14). The "allowable withstand pressure" of the bellows 13 (14) is a pressure difference between the pressure at the outer side of the bellows 13 (14) (in the discharge-side air chamber 21) and the pressure at the inner side of the bellows 13 (14), and is a maximum pressure difference with which the bellows 13 (14) is not deformed/broken.

As shown in FIG. 16, the allowable withstand pressure of the bellows 13 (14) is found to decrease as the temperature of the transport fluid increases. Thus, for protecting the bellows 13 (14), the start air pressures Ps1 to Ps3 (the initial air pressure b in the present embodiment) or the pressure increase coefficients a1 to a3 of the air pressure in the look-up table 6*f* (see FIG. 14) are set such that the maximum value of the air pressure (a gauge pressure not including the atmospheric pressure) corresponding to each temperature range does not exceed the allowable withstand pressure of the bellows 13 (14).

That is, as shown in FIG. 15, the start air pressures Ps1 to Ps3 or the pressure increase coefficients a1 to a3 are set such that end air pressures Pe1, Pe2, and Pe3 at a time point of end of contraction of the bellows 13 (14) that are maximum values of the air pressure corresponding to the low temperature range, the intermediate temperature range, and the high temperature range, respectively, do not exceed the allowable withstand pressures of the bellows 13 (14) corresponding to the highest temperatures of the respective temperature ranges.

For example, in the case of the high temperature range (60 to 80° C.), the start air pressure Ps3 or the pressure increase coefficient a3 is set such that the end air pressure Pe3 does not exceed the allowable withstand pressure (about 0.6 MPa in FIG. 16) of the bellows 13 (14) corresponding to 80° C. which is the highest temperature of the high temperature range.

The electropneumatic regulator 51 (52) is controlled by the control unit 6 as follows.

When the control unit 6 acquires the detection value of the temperature sensor 76, the control unit 6 refers to the look-up table 6*f* (see FIG. 14) and selects the temperature range in which the detection value is included.

For example, when the detection value of the temperature sensor 76 is 15° C., the control unit 6 refers to the look-up table 6*f* and selects the low temperature range (10 to 20° C.) as the temperature range in which the detection value is included.

Next, the control unit 6 refers to the look-up table 6*f* and determines the pressure increase coefficient a corresponding to the selected temperature range. For example, when the selected temperature range is the low temperature range, the control unit 6 refers to the look-up table 6*f* and determines the pressure increase coefficient a1 corresponding to the low temperature range, as the pressure increase coefficient a.

Next, the control unit 6 calculates an air pressure from the above equation by using the determined pressure increase coefficient a, and instructs the electropneumatic regulator 51 (52) to perform adjustment to the calculated air pressure. For example, when the determined pressure increase coefficient a is the pressure increase coefficient a1 for the low temperature range, the control unit 6 instructs an adjustment air pressure with respect to the electropneumatic regulator 51 (52) such that a pressure change corresponding to the low temperature range as shown by a solid line in FIG. 15 is achieved.

<Effect Verification by Examples and Comparative Examples>

A verification test conducted by the present inventors in order to verify the effects obtained by the bellows pump device BP of the present embodiment, will be described. In the verification test, the effects were verified by comparing and evaluating examples with control of the electropneumatic regulator in the present embodiment and comparative examples with control of the electropneumatic regulator in the conventional art, for change of the discharge pressure of the transport fluid discharged from the bellows pump.

Figure 17:
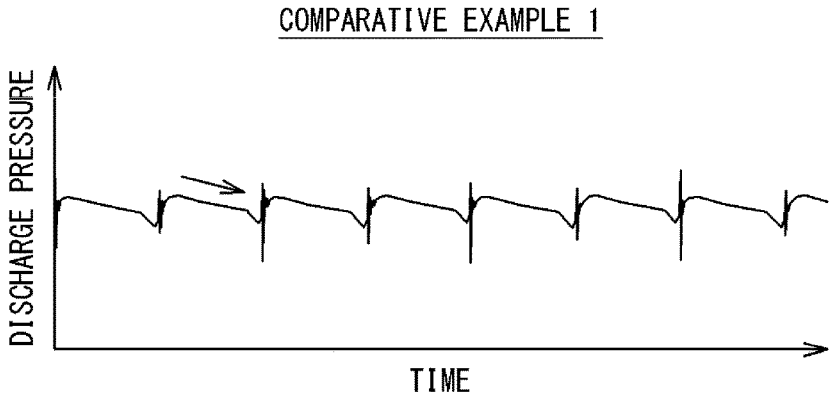
FIG. 17 is a graph showing change of the discharge pressure of the transport fluid discharged from a bellows pump through control of an electropneumatic regulator according to Comparative Example 1.

FIG. 17 is a graph showing change of the discharge pressure of the transport fluid discharged from the bellows pump through control of the electropneumatic regulator according to Comparative Example 1.

Specifically, FIG. 17 is a graph showing the discharge pressure of the transport fluid discharged from the bellows pump when the electropneumatic regulator is controlled by using the pressure increase coefficient corresponding to the intermediate temperature range in the case where the temperature of the transport fluid is included in the low temperature range, in Comparative Example 1.

In Comparative Example 1 shown in FIG. 17, as shown by an arrow in the drawing, the discharge pressure of the transport fluid decreases while the bellows contracts. The reason for the decrease of the discharge pressure is thought to be that, even though the bellows becomes hard to be difficult to contract due to the temperature decrease of the transport fluid, the pressurized air having the air pressure corresponding to the intermediate temperature range which is lower than the air pressure corresponding to the low temperature range is supplied to the air chamber during contraction operation of the bellows, so that the air pressure acting on the bellows is insufficient.

Figure 18:
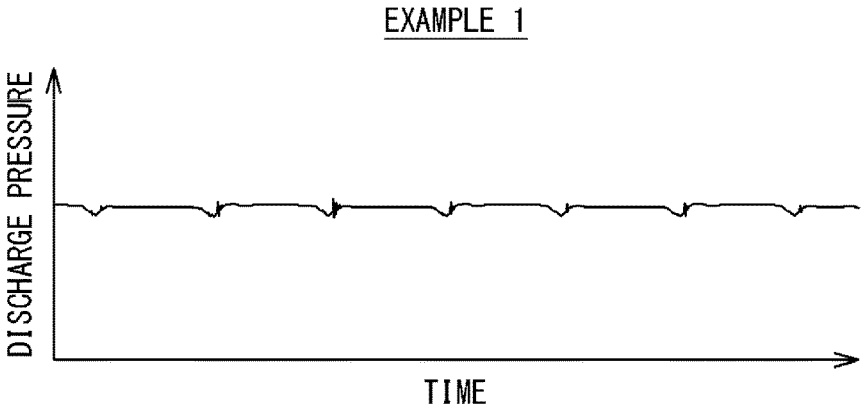
FIG. 18 is a graph showing change of the discharge pressure of the transport fluid discharged from a bellows pump through control of an electropneumatic regulator according to Example 1 of the second embodiment.

FIG. 18 is a graph showing change of the discharge pressure of the transport fluid discharged from the bellows pump through control of the electropneumatic regulator according to Example 1.

Specifically, FIG. 18 is a graph showing the discharge pressure of the transport fluid discharged from the bellows pump when the electropneumatic regulator is controlled by using the pressure increase coefficient corresponding to the low temperature range in the case where the temperature of the transport fluid is included in the low temperature range, in Example 1.

In Example 1 shown in FIG. 18, the discharge pressure of the transport fluid almost does not change while the bellows contracts. Therefore, when Comparative Example 1 in FIG. 17 and Example 1 in FIG. 18 are compared to each other, it is found that, in the case where the temperature of the transport fluid is included in the low temperature range, change of the discharge pressure of the transport fluid discharged from the bellows pump can be suppressed more by controlling the electropneumatic regulator using the pressure increase coefficient corresponding to the low temperature range, than using the pressure increase coefficient corresponding to the intermediate temperature range.

Figure 19:
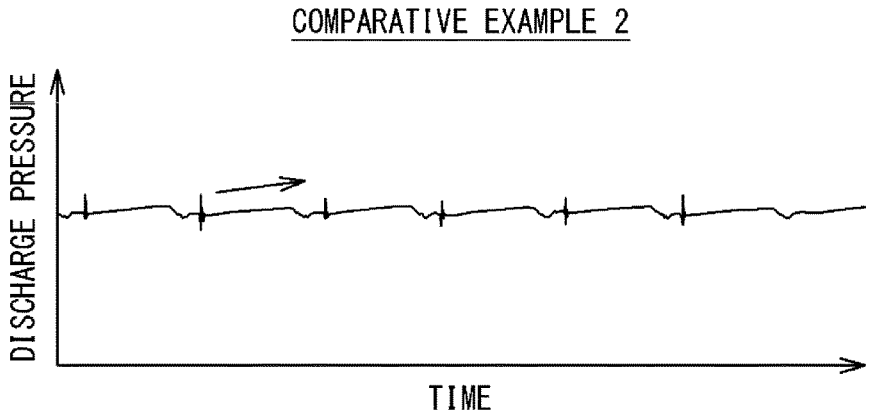
FIG. 19 is a graph showing change of the discharge pressure of the transport fluid discharged from a bellows pump through control of an electropneumatic regulator according to Comparative Example 2.

FIG. 19 is a graph showing change of the discharge pressure of the transport fluid discharged from the bellows pump through control of the electropneumatic regulator according to Comparative Example 2.

Specifically, FIG. 19 is a graph showing the discharge pressure of the transport fluid discharged from the bellows pump when the electropneumatic regulator is controlled by using the pressure increase coefficient corresponding to the intermediate temperature range in the case where the temperature of the transport fluid is included in the high temperature range, in Comparative Example 2.

In Comparative Example 2 shown in FIG. 19, as shown by an arrow in the drawing, the discharge pressure of the transport fluid increases while the bellows contracts. The reason for the increase of the discharge pressure is thought to be that, even though the bellows becomes flexible to be easy to contract due to the temperature increase of the transport fluid, the pressurized air having the air pressure corresponding to the intermediate temperature range which is higher than the air pressure corresponding to the high temperature range during contraction operation of the bellows, so that an excessive air pressure acts on the bellows.

Figure 20:
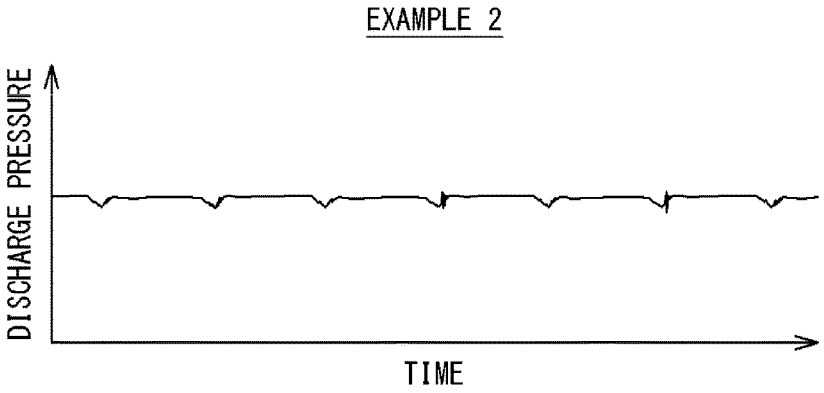
FIG. 20 is a graph showing change of the discharge pressure of the transport fluid discharged from a bellows pump through control of an electropneumatic regulator according to Example 2 of the second embodiment.

FIG. 20 is a graph showing change of the discharge pressure of the transport fluid discharged from the bellows pump through control of the electropneumatic regulator according to Example 2.

Specifically, FIG. 20 is a graph showing the discharge pressure of the transport fluid discharged from the bellows pump when the electropneumatic regulator is controlled by using the pressure increase coefficient corresponding to the high temperature range in the case where the temperature of the transport fluid is included in the high temperature range, in Example 2.

In Example 2 shown in FIG. 20, the discharge pressure of the transport fluid almost does not change while the bellows contracts. Therefore, when Comparative Example 2 in FIG. 19 and Example 2 in FIG. 20 are compared to each other, it is found that, in the case where the temperature of the transport fluid is included in the high temperature range, change of the discharge pressure of the transport fluid discharged from the bellows pump can be suppressed more by controlling the electropneumatic regulator using the pressure increase coefficient corresponding to the high temperature range, than using the pressure increase coefficient corresponding to the intermediate temperature range.

Figure 21:
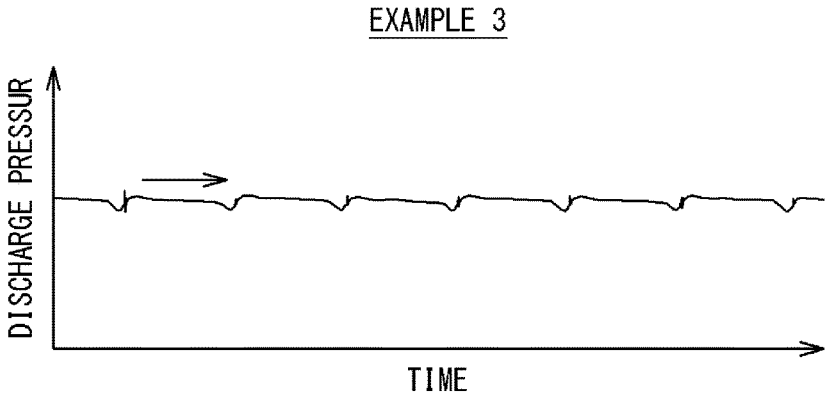
FIG. 21 is a graph showing change of the discharge pressure of the transport fluid discharged from a bellows pump through control of an electropneumatic regulator according to Example 3 of the second embodiment.
Figure 22:
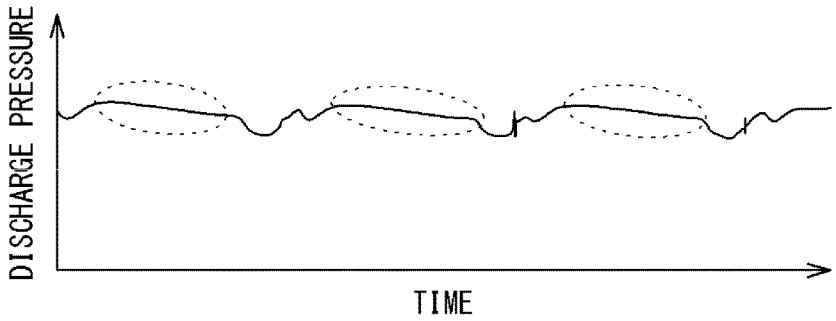
FIG. 22 is a graph showing the discharge pressure of a transport fluid discharged from a conventional bellows pump.

FIG. 21 is a graph showing change of the discharge pressure of the transport fluid discharged from the bellows pump through control of the electropneumatic regulator according to Example 3.

Specifically, FIG. 21 is a graph showing the discharge pressure of the transport fluid discharged from the bellows pump when the electropneumatic regulator is controlled by using the pressure increase coefficient corresponding to the intermediate temperature range in the case where the temperature of the transport fluid is included in the intermediate temperature range, in Example 3.

In Example 3 shown in FIG. 21, the discharge pressure of the transport fluid almost does not change while the bellows contracts. Therefore, it is found that change of the discharge pressure of the transport fluid discharged from the bellows pump can be suppressed more when the pressure increase coefficient corresponding to the intermediate temperature range is used in the case where the temperature of the transport fluid is included in the intermediate temperature range, than when the pressure increase coefficient corresponding to the intermediate temperature range is used in the case where the temperature of the transport fluid is included in the low temperature range or the high temperature range as in Comparative Example 1 in FIG. 17 or Comparative Example 2 in FIG. 19.

As described above, according to the bellows pump device BP of the present embodiment, the control unit 6 controls the electropneumatic regulator 51 (52) such that the pressure increase coefficient a for the air pressure of the pressurized air to be supplied to the discharge-side air chamber 21 during contraction operation of the bellows 13 (14) increases as the temperature of the transport fluid detected by the temperature sensor 76 decreases. Accordingly, for example, even when the temperature of the transport fluid decreases so that the bellows 13 (14) becomes hard, the bellows 13 (14) can be caused to contract by the air pressure higher than the air pressure prior to the temperature decrease of the transport fluid, since the pressure increase coefficient for the air pressure of the pressurized air to be supplied to the discharge-side air chamber 21 increases. Therefore, even when the hardness of the bellows 13 (14) changes due to a temperature change of the transport fluid, change of the discharge pressure of the transport fluid during contraction of the bellows 13 (14) can be suppressed.

The start air pressures Ps1 to Ps3 or the pressure increase coefficient a for the air pressure of the pressurized air is set on the basis of the detection value of the temperature sensor 76 such that the maximum value of the air pressure does not exceed the allowable withstand pressure of the bellows 13 (14). Thus, even when the pressure increase coefficient a for the air pressure increases, the maximum value of the air pressure does not exceed the allowable withstand pressure of the bellows 13 (14). Therefore, the bellows 13 (14) can be prevented from being deformed or broken due to an increase in the air pressure.

Since the control unit 6 has the look-up table 6*f* in which the pressure increase coefficient a is set so as to correspond to each of the plurality of temperature ranges, the control unit 6 can easily control the electropneumatic regulator 51 (52) on the basis of the look-up table 6*f*.

The points of which the description is omitted in the second embodiment are the same as in the first embodiment.

<OTHERS>

The present invention is not limited to the above embodiments, and changes may be made as appropriate within the scope of the present invention described in the claims. For example, other than the above embodiments, the bellows pump 1 is also applicable to other bellows pumps such as a bellows pump having a pair of right and left bellows integrally connected to each other by a tie rod, a bellows pump in which one of a pair of bellows is replaced with an accumulator, or a single-type bellows pump configured with only one bellows of a pair of bellows.

The electropneumatic regulators 51 to 53 are disposed at the upstream sides of the switching valves 4, 5, and 54, but may be disposed at the downstream sides of the switching valves 4, 5, and 54. However, in this case, impact pressures generated when the switching valves 4, 5, and 54 are switched act at the primary sides of the electropneumatic regulators 51 to 53. Thus, the electropneumatic regulators 51 to 53 are preferably disposed at the upstream sides of the switching valves 4, 5, and 54, from the standpoint of preventing breakdown of the electropneumatic regulators 51 to 53.

The first and second detection device 29 and 31 in the above embodiment are composed of proximity sensors, but may be composed of other detection device such as limit switches or the like. In addition, the first and second detection device 29 and 31 detect the most expanded states and the most contracted states of the first and second bellows 13 and 14, but may detect other expanded/contracted states thereof. Furthermore, the first and second driving devices 27 and 28 in the present embodiment are driven by the pressurized air, but may be driven by another fluid, a motor, or the like.

REFERENCE SIGNS LIST

6 control unit
6*f* look-up table
7 temperature detection unit
13 first bellows (bellows)
14 second bellows (bellows)
21 discharge-side air chamber (air chamber)
27 first air cylinder portion (first driving device)
28 second air cylinder portion (second driving device)
29 first detection device
31 second detection device
51 first electropneumatic regulator (electropneumatic regulator)
52 second electropneumatic regulator (electropneumatic regulator)
53 electropneumatic regulator

The invention claimed is:

1. A bellows pump device that supplies pressurized air to a hermetic air chamber thereby to cause a bellows disposed within the air chamber to perform contraction operation to discharge a transport fluid, and discharges the pressurized air from the air chamber thereby to cause the bellows to perform expansion operation to suck the transport fluid, the bellows pump device comprising:

an electropneumatic regulator configured to adjust an air pressure of the pressurized air to be supplied to the air chamber, such that the air pressure is increased so as to correspond to a contraction characteristic of the bellows during the contraction operation of the bellows;

a temperature detection unit configured to detect a temperature of the transport fluid; and a control unit configured to control the electropneumatic regulator such that a pressure increase coefficient used in increasing the air pressure increases as a detection value of the temperature detection unit decreases.

2. The bellows pump device according to claim 1, wherein the electropneumatic regulator adjusts the air pressure by using the following equation:

$$P=aX+b,$$

wherein P denotes the air pressure, a denotes a pressure increase coefficient, X denotes an expansion/contraction position of the bellows, and b denotes an initial air pressure.

3. The bellows pump device according to claim 1, wherein the bellows includes a first bellows and a second bellows that are expandable/contractible independently of each other, and the bellows pump device further comprises:

a first driving device configured to cause the first bellows to perform expansion/contraction operation continuously between a most expanded state and a most contracted state;

a second driving device configured to cause the second bellows to perform expansion/contraction operation continuously between a most expanded state and a most contracted state;

a first detection device configured to detect an expanded/contracted state of the first bellows; and a second detection device configured to detect an expanded/contracted state of the second bellows; wherein the control unit is configured to control drive of the first and second driving devices on the basis of each of detection signals of the first and second detection device such that the second bellows is caused to contract from the most expanded state before the first bellows comes into the most contracted state, and the first bellows is caused to contract from the most expanded state before the second bellows comes into the most contracted state.

4. The bellows pump device according to claim 1, wherein the control unit sets the pressure increase coefficient for the air pressure on the basis of the detection value of the temperature detection unit such that a maximum value of the air pressure does not exceed an allowable withstand pressure of the bellows.

5. The bellows pump device according to claim 1, wherein the control unit has a look-up table in which the pressure increase coefficient is set so as to correspond to each of a plurality of temperature ranges, and controls the electropneumatic regulator on the basis of the look-up table.

* * * * *